US008523469B2

(12) United States Patent
Abergel

(10) Patent No.: US 8,523,469 B2
(45) Date of Patent: Sep. 3, 2013

(54) PACKAGING AND APPLICATION DEVICE

(75) Inventor: Aline Abergel, Boulogne (FR)

(73) Assignee: L'Oreal, Paris (FR)

( * ) Notice: Subject to any disclaimer, the term of this patent is extended or adjusted under 35 U.S.C. 154(b) by 1158 days.

(21) Appl. No.: 11/963,495

(22) Filed: Dec. 21, 2007

(65) Prior Publication Data

US 2008/0149126 A1 Jun. 26, 2008

Related U.S. Application Data

(60) Provisional application No. 60/883,282, filed on Jan. 3, 2007.

(30) Foreign Application Priority Data

Dec. 21, 2006 (FR) ..... 06 55780

(51) Int. Cl.
*B43K 27/04* (2006.01)

(52) U.S. Cl.
USPC ..... 401/35; 401/34; 401/22; 401/18

(58) Field of Classification Search
USPC ..... 401/16, 17, 18, 22, 23, 26, 34, 35; 222/94, 105
See application file for complete search history.

(56) References Cited

U.S. PATENT DOCUMENTS

| | | | | |
|---|---|---|---|---|
| 2,291,282 | A * | 7/1942 | Hollenbeck | 401/288 |
| 3,100,063 | A * | 8/1963 | Henriksen | 222/94 |
| 3,323,682 | A * | 6/1967 | Creighton, Jr. et al. | 222/94 |
| 4,705,051 | A | 11/1987 | Bacon et al. | |
| 4,884,703 | A | 12/1989 | O'Meara | |
| 5,137,178 | A | 8/1992 | Stokes et al. | |
| 5,307,954 | A * | 5/1994 | Gick et al. | 222/94 |
| 5,356,040 | A | 10/1994 | Reggiani | |
| 6,889,870 | B2 | 5/2005 | De Laforcade | |
| 2005/0098527 | A1 | 5/2005 | Yates, III | |
| 2005/0184091 | A1 | 8/2005 | Abergel | |
| 2005/0205600 | A1 | 9/2005 | Ophardt et al. | |
| 2006/0108247 | A1 | 5/2006 | Liechty et al. | |

FOREIGN PATENT DOCUMENTS

| | | |
|---|---|---|
| EP | 0 644 129 | 3/1995 |
| FR | 2 647 093 | 11/1990 |
| FR | 2 826 641 | 1/2003 |
| FR | 2 867 700 | 9/2005 |
| FR | 2 877 819 | 5/2006 |
| GB | 2 307 674 | 6/1997 |
| GB | 2 388 097 | 11/2003 |
| JP | 8-198344 | 8/1996 |

* cited by examiner

*Primary Examiner* — David Walczak
(74) *Attorney, Agent, or Firm* — Oblon, Spivak, McClelland, Maier & Neustadt, L.L.P.

(57) ABSTRACT

A packaging and application device includes a first container which can contain a first product, with the first container including a deformable wall, so as to enable the first product to be dispensed through a first dispensing orifice. The device further includes a second container which can contain a second product, with the second container including a deformable wall, so as to enable the second product to be dispensed through a second dispensing orifice. According to an example, a coupling arrangement is mounted on the containers and joins the first and second containers together. The first and second dispensing orifices emerge separately at the level of a first application surface and a second application surface respectively, and the first and second containers are configured so as to be able to be actuated independently of one another.

33 Claims, 11 Drawing Sheets

PACKAGING AND APPLICATION DEVICE

CROSS-REFERENCE TO RELATED APPLICATIONS

This document claims priority to French Application Number 06 55780, filed Dec. 21, 2006 and U.S. Provisional Application No. 60/883,282, filed Jan. 3, 2007, the entire contents of which are hereby incorporated by reference.

BACKGROUND OF THE INVENTION

1. Field of the Invention

The present invention relates to a device for packaging and applying at least one cosmetic product. One favored, but not exclusive, application of the present invention is for the application of a mixture of cosmetic products to an area of the body such as the lips, eyelids, cheeks or nails. The expression "cosmetic product" is understood to mean a product such as defined in Council Directive 93/35/EEC of 14 Jun. 1993.

2. Discussion of Background

Many devices that make it possible to store various cosmetic products to be mixed extemporaneously (when use is desired) for the purpose of applying this mixture to an area of the body are listed in the prior art.

US Publication 2005/098527, U.S. Pat. No. 4,705,051, U.S. Pat. No. 4,884,703, U.S. Pat. No. 5,137,178, EP 0 644 129, GB 2 388 097, JP 08 198 344, FR 2 647 093, FR 2 826 641, FR 2 867 700 and FR 2 877 819 disclose examples of such devices.

U.S. Pat. No. 5,137,178 discloses a device comprising two flexible product containers attached to a common dispensing head. In order to do this, these containers both comprise an end equipped with a ridge able to be fixedly snap-fastened into two grooves made in the common dispensing head. These containers are surrounded by a first casing shell comprising two panels that form pushbuttons. Such pushbuttons make it possible to compress the containers together so as to cause the products contained in the two containers to be dispensed.

This first casing shell is mounted in a second casing shell that has openings for the pushbuttons. The pushbuttons can be moved relative to the second casing shell.

However, one drawback associated with this device is that it consists of numerous parts to be manufactured and assembled. Such a device therefore has very tight manufacturing tolerances especially for the design of the first and second casing shells in order to ensure that the pushbuttons are easily accessible from the outside.

In addition, with this device of the prior art, a dispensing head common to the two containers is provided. However, each time a product is dispensed, a residue of product may remain in the dispensing channel. Quite often, the product dries out and lines the dispensing channel on a long-term basis. Thus, if one container is replaced by a container that contains a different product, the product dispensed from this new container may be soiled by the old product coating the dispensing channel.

Furthermore, it is clear that such a device does not make it possible to easily replace an empty container with a new container.

EP 0 644 129 discloses a device that includes two product containers respectively equipped with a dispensing valve. This valve is actuated by means of a common dispensing head. The valves are arranged in fluid communication with dispensing channels provided in the dispensing head, and the channels open into a respective dispensing orifice. In such a device, pressure exerted on the dispensing head ensures simultaneous actuating of the dispensing valves and thus simultaneous dispensing of product.

However, one drawback associated with this device is that it does not provide for dispensing of one product from one container independently of the product contained in the other container. In addition, the dispensing of products simultaneously may result in a reciprocal contamination of the product dispensed which may not be desired in certain cases, especially when one product must be applied before the other. Specifically, the contact of one product with the other may lead to physicochemical modifications of one or both of the products. Furthermore, the amounts of product dispensed are substantially identical for each container.

FR 2 647 093 discloses two flexible-walled product containers, each having a respective dispensing channel. The dispensing channels are surmounted by a common dispensing head provided with a dispensing orifice. When manual pressure is exerted on these two containers, the products contained inside are both dispensed through their respective dispensing channel, and then mixed and expelled through the dispensing orifice.

However, one drawback associated with this device is that the positioning of the dispensing head on the two containers causes an inclination of the dispensing channels in the direction of the dispensing orifice. Thus, when a manual pressure exerted on one container is stopped, the product dispensed through one dispensing channel may easily flow back toward the other dispensing channel and thus contaminate the other container. Moreover, product dispensed from one container may remain stagnant in the common dispensing head and may thus contaminate a newly dispensed product.

SUMMARY OF THE INVENTION

One object of the present invention is therefore to provide a device that overcomes at least one of the aforementioned drawbacks.

One object of the present invention is to provide a device that is easy to manufacture and to assemble.

In particular, one object of the present invention is to provide a rechargeable device which avoids or reduces the possibility of products contamination. One object of the present invention is especially to avoid or reduce the presence of stagnating product residues resulting from a previous use of the device.

One object of the present invention is also to provide a device allowing a personalizable mixture of the products contained in the various containers.

One object of the present invention is also to provide a device having an actuating movement that is original and comfortable for the user.

Therefore, according to a first aspect, one example of the present invention provides a packaging and application device, extending along an axis including a first container intended to contain a first product, with the first container including a deformable wall, so as to enable the first product to be dispensed through a first dispensing orifice. In addition, a second container contains a second product, with the second container including a deformable wall, so as to enable the second product to be dispensed through a second dispensing orifice. A coupling means or coupling arrangement is capable of joining the first and second containers together, with the first and second dispensing orifices emerging separately at the level of a first application surface and a second application surface respectively. In addition, the first and second containers are configured so as to be able to be actuated independently of one another. In a preferred example, the coupling arrangement is mounted on the first and second containers, or in other words, the coupling arrangement is a separate part(s) from the first and second containers.

According to an example, the device can include a transverse cross section having an elongated shape that defines an outer envelope having a length and a width, with the first and second containers being coupled together widthwise. In other words, the side walls of the first and second containers can face one another and may extend along a minor axis (or width—or smaller dimension) of the transverse cross section. In the coupled state, the first and second containers may thus be arranged opposite, for example in contact with, one another about one respective side having a smaller dimension. Such a configuration thus makes it possible to actuate a container by a pressure or compression exerted on its body without interfering with the other container. In such a case, the bearing force, or compressive force, exerted on the container may be carried out in a direction that is not secant to the adjacent container. This direction may be different from a direction for dispensing a product, and may for example be substantially orthogonal to this dispensing direction. This direction may be substantially parallel to a coupling mid-plane of the first and second containers.

Further, according to an example, the first and second containers can be arranged so that they each include at least one actuating wall extending in the length of the transverse cross section, and advantageously two actuating walls. In the case where two actuating walls are provided for one and the same container, the walls may thus each extend along a major axis or length of the transverse cross section and on both sides of this axis. These two actuating walls may be provided on both sides of the coupling means or coupling arrangement, and especially on both sides of a flexible part of the coupling means.

The first and second containers can be at least partly produced from a flexible, and especially elastically deformable, material capable of being manually deformed by a user. These first and second containers can include a container body that defines the actuating wall. For example, the containers can respectively include a base from which a side wall joined to application means, or respective nozzles, stands up, at least one part of this side wall forming the actuating wall. The application means may be formed, for example, by a common nozzle surmounting the first and second containers.

Further by way of example, the actuating walls and the application surfaces may extend in the length, or along a major axis, of a transverse cross section of the device. Actuation of the device and the application of product therefrom are thus facilitated. For actuation, the user can grip a container using all their fingers without interfering with the other container. Thus, the user may compress one container with one hand and the other container with their other hand. In order to do this, the user may position their thumb on one side wall of a container and at least one of their other fingers on an opposite side wall of this same container. A compression in a direction to bring together their thumb and at least one of their other fingers makes it possible to start dispensing product from this container. By releasing the digital pressure exerted on these walls, the container may then return to its initial configuration. In this maneuver, the actuating of one container absolutely does not interfere with the other container.

According to a preferred example, the first and second containers can have a generally identical configuration and preferably identical shapes and dimensions.

The X axis can be an axis that is secant, and preferably orthogonal, to one of the first and second dispensing orifices. In other words, this axis can extend through one of the dispensing orifices. It can also be an axis of elongation of the device.

Also by way of example, the first and second containers can be coupled together so as to be arranged side by side. The expression "side by side" should be understood to mean that the containers are oriented in the same manner. These containers are thus arranged so that their bodies, and optionally their respective or common application means, are positioned adjacent, or even bracketed, to one another. Their bases may be free. These bases may then be arranged or configured to rest in a stable manner on a rest plane.

By way of example, the first and second application surfaces may be in contact with one another. The first and second application surfaces can be flush with one another. In addition, the first and second application surfaces can together define a continuous application surface.

The first and second containers may be coupled together about a coupling mid-plane essentially parallel or oblique to the width.

Further by way of example, the first and second dispensing orifices can extend along an axis oblique or perpendicular to a coupling plane of the first and second containers. The device can have a transverse cross section of elliptical shape. The coupling means or coupling arrangement can include, for example, a band surrounding at least one part of the first and second containers while leaving the deformable walls accessible. The coupling means can be reversible so that the first and second containers may be easily separated from one another. Also by way of example, the coupling means can include a flexible part capable of tightly gripping around the first and second containers.

The first and second containers can include, for example, a container body surmounted by a respective or common nozzle provided with first and second application surfaces. These application surfaces can thus be formed by the nozzle itself or by an additional application member arranged opposite or in the proximity of the dispensing orifices. By way of example, such an additional application member can include a porous member such as a foam, flocking, woven material, nonwoven material, bristles, teeth or other application devices. The nature of an application member may vary from one orifice to the other or they can be identical. The dispensing member may cover or extend in or around the periphery of the dispensing orifices.

Each nozzle can be produced as a single part with its container body, for example by injection blow molding or extrusion blow molding. This nozzle can be joined to its container body by a projection or shoulder. Alternately each nozzle can be added onto its respective container body. In this case, the nozzle or nozzles can be attached by any suitable means, such as by close fitting or snap-fastening.

According to an example, each nozzle can include a lateral surface that extends in the extension of a smaller-dimensioned assembly side wall of the first and second container bodies, and these lateral surfaces can come into contact with one another over substantially their entire height. These nozzles can be flush with one another in the coupled state of the first and second containers.

Also by way of example, the coupling means can include application means in contact with the first and second dispensing orifices. In particular, the coupling means can include a cover mounted on the first and second containers, including at least one opening arranged opposite the first and second dispensing orifices. This cover can itself define common or separate respective first and second application surfaces.

Alternately, an additional application member such as described previously can be provided.

The orifices, or where appropriate the at least one opening, can open into (or be made in) a common or respective basin. This basin can be used to visualize the product or products dispensed and/or to apply the product or products onto a keratinous surface.

The coupling arrangement or coupling means can, for example, include a collar topping the first and second containers, with a flexible part extending from the collar so as to at least partially surround the first and second containers. The flexible part can include at least two branches capable of coming into close contact against one opposing respective side wall of the first and second containers. The flexible part can leave two actuating walls free for each container. For a given container, these actuating walls can thus extend on both sides of the flexible part. Such actuating walls can thus be directly accessible by the user in order to be compressed. The flexible part could be joined to a strut able to be positioned in contact with the bases of the containers.

Further by way of example, the coupling means can be attached by snap-fastening to the first and second containers. For example, the flexible part and the first and second containers can both include complementary reliefs.

The flexible part can extend at least partly in the length of the transverse cross section of the device.

The coupling means can extend over substantially the entire height of the first and second containers. For example, the flexible part may extend over substantially the entire height of the container bodies.

The flexible part can extend along, and for example in contact with, a respective curved wall of the first and second containers.

As a further example, the coupling means can include attachment means or an attachment location for a cap.

According to an example of an embodiment, the coupling means can extend between the first and second containers. For example, the coupling means can include a plate added between the first and second containers onto which the first and second containers are attached by snap-fastening. For example, the plate and the first and second containers can include complementary snap-fastening profiles. These coupling means may be produced, for example, as a single part with application means topping (or at the top of) the first and second containers. As in the earlier described embodiments, the coupling arrangement is mounted onto the containers (in other words, it is a separate part(s) from the first and second containers).

One object of the present invention is, according to a second aspect, to provide a packaging and application device extending along an axis, including a first container intended to contain a first product, with the first container including a deformable wall, so as to enable the first product to be dispensed through a first dispensing orifice. In addition, a second container is provided to contain a second product, with the second container including a deformable wall, so as to enable the second product to be dispensed through a second dispensing orifice. In addition, a coupling means or arrangement is capable of joining the first and second containers together. The device defines a transverse cross section having an elongated shape with a length and a width, with the first and second containers being coupled together widthwise in order to be able to be actuated independently of one another.

All the technical features previously introduced may also be combined with this object or example of the invention.

With this example, the first and second dispensing orifices can be joined together and open upon a common or separate application surface.

The dispensing orifices can extend along a respective longitudinal axis secant to an elongation axis of the device, for example an oblique axis. For example, the orifices can be oriented toward one another. They may be, for example, symmetrical relative to a plane of elongation of the device and especially relative to a plane for assembly of the containers. The first and second containers can, for example, be coupled together by the two types of coupling devices which are mentioned below.

The coupling means or arrangement may be added on or mounted on the containers (in other words, formed as a separate part(s) from the containers) or, as a variant, be produced as a single part with the first and second containers.

Such a device can facilitate the actuation of the first and second containers and thus enable better metering of the products dispensed.

One object of the invention is, according to a third aspect, to provide a packaging and application device extending along an axis and including a first container to contain a first product, with the first container including a deformable wall, so as to enable the first product to be dispensed through a first dispensing orifice, with the device also including a second container to contain a second product, with the second container including a deformable wall, so as to enable the second product to be dispensed through a second dispensing orifice. In addition, coupling means or a coupling arrangement is capable of joining the first and second containers together. Further, the first and second containers are configured so as to be able to be actuated independently of one another so that an actuating force or a compressive force exerted, for example manually, on one deformable wall of one of the first and second containers, for example on its body, may be carried out along a direction that is not secant to the other container.

All the technical features previously introduced may also be combined with this object or example of the invention.

The direction of actuation or compression can be different from a direction of dispensing of a product, and may for example be substantially orthogonal to this dispensing direction. This direction may also be substantially parallel to a mid-plane for assembling the containers.

One object of the present invention is, according to a fourth aspect, to provide a device for coupling together a first container and a second container arranged side by side, with a coupling means or coupling arrangement including a collar at least partly topping the first and second containers, from which extends a flexible part capable of tightly gripping around the first and second containers.

All the technical features previously introduced can also be combined with this object or example of the invention.

The coupling means or coupling arrangement can at least partly surround respective side walls of the first and second container bodies. The coupling means can extend, for example, over more than half of the height of the first and second containers, and preferably over the entire height of the containers or even beyond. They can also at least partly surround the at least one nozzle.

By way of example, the coupling means can include a collar configured to surround the application means. This collar can thus surround the nozzle or nozzles and optionally can be engaged in close contact around the nozzle or nozzles. This collar can include an opening through which a nozzle, respective or common to the first and second containers, extends. Product application can be carried out by way of the nozzle or the coupling means. The coupling means can include means or an arrangement for attachment of the container bodies.

Also by way of example, the coupling means can include a crown that stands up from the collar. This crown can then at least partly surround at least one nozzle. This crown can be, for example, a tubular body open at both of its ends. It can have a shape complementary to that of the at least one nozzle. It can optionally be tightly gripped with this nozzle. Such a crown can include, on the one hand, a mounting opening, optionally provided with an attachment means for the container bodies and, on the other hand, at least one opening positioned opposite at least one dispensing orifice.

Further by way of example, the crown can be surmounted by a cover possibly or optionally forming an application means or application member. As a variant, an application member can be added to this cover to provide an application means. According to an example, the flexible part can extend from the collar. This flexible part can extend from one side of the collar opposite to that from which the crown stands up. The crown and this flexible part can thus extend along two opposite directions. This flexible part can include, for example, at least two branches. These branches can come into close contact against one respective, for example, opposite, side wall of the container bodies. Each branch can extend between two actuating walls of one and the same container. These branches can extend from one and the same side of the collar, and can respectively extend from opposite portions of the collar, for example from longitudinally opposite portions. Such branches may both be curved. This curvature may be reversed from one branch relative to the other. For example, these branches may be an image of one another relative to a plane of symmetry passing through the collar. These branches can together define a cut-out that defines a space for receiving the first and second containers. Such branches can extend over substantially the entire height of the container bodies.

The branches can thus be mounted over the respective outer circumference of the first and second containers. The branches can tightly grip around the first and second containers, and optionally over opposite portions of the first and second containers. The branches can both have a general profile complementary to that of the containers. For example, the branches can extend along a respective curved side wall of the container bodies. Where desired, they can be in close contact against these walls.

By way of example, the branches can include an inner face provided with at least one relief able to cooperate with a complementary relief of the first and second containers. Such reliefs can include a longitudinal rib able to cooperate with a corresponding groove or vice versa.

The branches can thus keep the container bodies, and also optionally their associated nozzle(s), joined together. Such branches can leave at least one lateral surface of each container free, or even two opposite lateral surfaces of each container. A user can thus bring their fingers directly in contact with the respective lateral surfaces of the container so as to compress the container in order to dispense product.

The branches can include, for example, a free end that is flattened against the container, especially in proximity to the base of the containers.

As an alternative example, the branches can be joined to one another by a strut. This strut can be positioned under the respective bases of the first and second containers, for example as a stop. Such a strut can define an axis of elongation substantially parallel to an axis of elongation of the collar.

According to another alternate example, the strut can include at least two radial flanges that can each extend under the containers, optionally coming to rest against their base. Each flange can extend, for example, from one respective branch and especially from an end portion of these branches. The flanges can thus include one respective free edge distant from one another. Such flanges can be oriented toward one another.

This strut can include at least one relief that can cooperate with at least one complementary relief made in the bases of the containers. Such reliefs can, for example, include a rib that cooperates with a corresponding groove.

The branches can also extend beyond the strut. Such branches can then be joined to one another at an end portion. A cut-out can be provided between the strut and this end portion. Such branches can then have a general cove or arch shape. This extension of the branches can provide an arrangement or means able to be strained by the user so as to facilitate the detachment of the coupling means relative to the containers, for example when one container is replaced by another.

With respect to a transverse cross section of the device, the at least two branches can extend in a length (L) (or in a direction of the length), or over a major axis, of this cross section, for example. During the assembly of the first and second containers, the branches may optionally be separated from one another, for example by being deformed radially toward the outside so as to thoroughly force the containers assembled against one another.

Further by way of example, the coupling means or arrangement can include an attachment or attachment means for a cap. The attachment means can include a snap-fastening arrangement, a thread, or a surface configured to receive a cap to be assembled by a tightly gripping arrangement. These attachment arrangements can, for example, be provided on the crown.

One object of the present invention is, according to a fifth aspect or example, to provide a device for coupling, where appropriate side by side, a first container with a second container, with each including a deformable actuating wall, especially formed by their body, with the device including coupling means that include a plate added between the first and second containers onto which the first and second containers are attached by snap-fastening.

All the technical features previously introduced may also be combined with this object or example of the invention.

Another object of the present invention is, according to a sixth aspect, to provide a method of applying a cosmetic product, with the method including a device such as described previously, and actuating the first and second containers independently in order to dispense the first product and the second product in different proportions onto an area of the body, such as the lips. The method further includes spreading and mixing the first and second products on the area of the body using an applicator member or application means.

As should be apparent, the invention can provide a number of advantageous features and benefits. It is to be understood that, in practicing the invention, an embodiment can be constructed to include one or more features or benefits of embodiments disclosed herein, but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

A better understanding of the invention will be gained from reading the following description in conjunction with the accompanying figures. The figures are offered purely as a guide and by way of example, and in no way limit the invention.

DETAILED DESCRIPTION OF THE PREFERRED EMBODIMENTS

Figure 1:
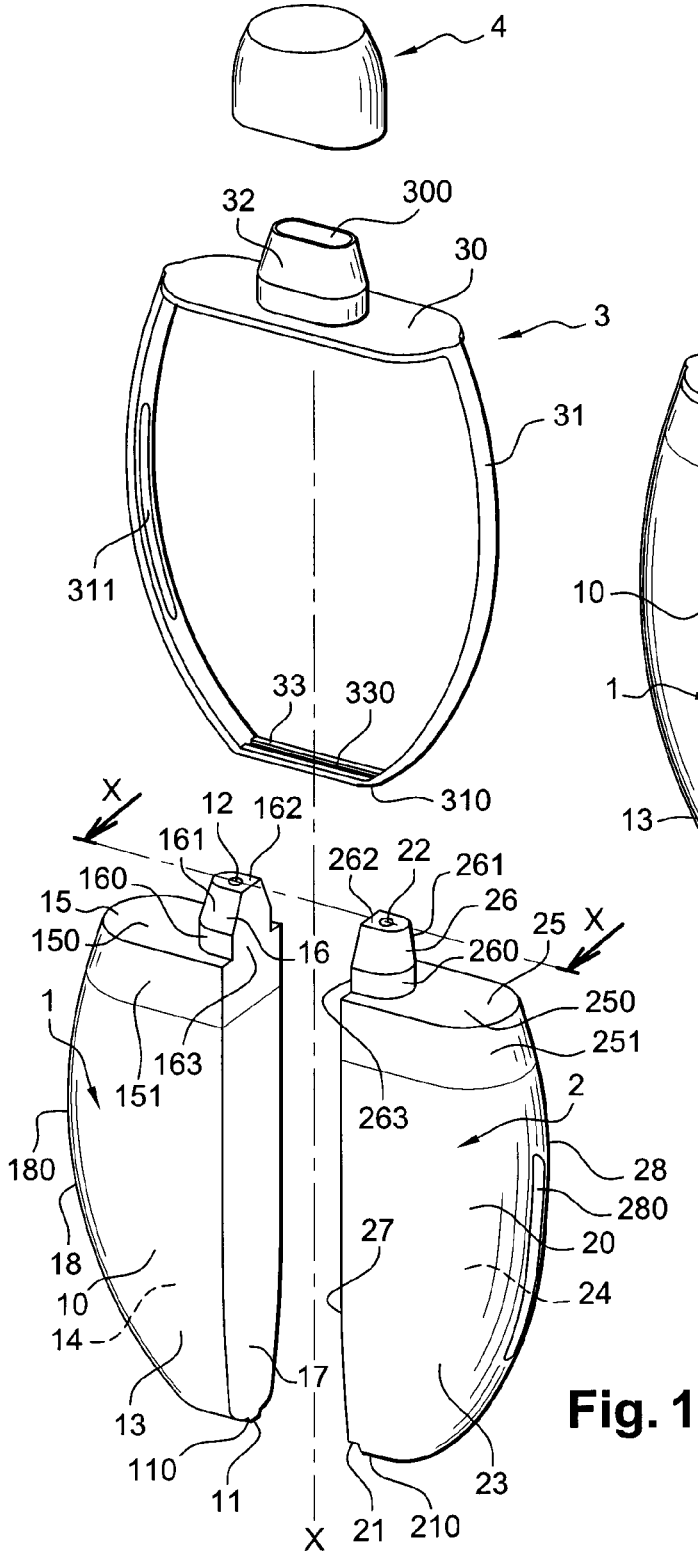
FIG. 1 is an exploded schematic perspective view of one embodiment of a device according to the invention.

Referring now to the drawings, like reference numerals are utilized to designate identical or corresponding parts throughout the several views.

Figure 2:
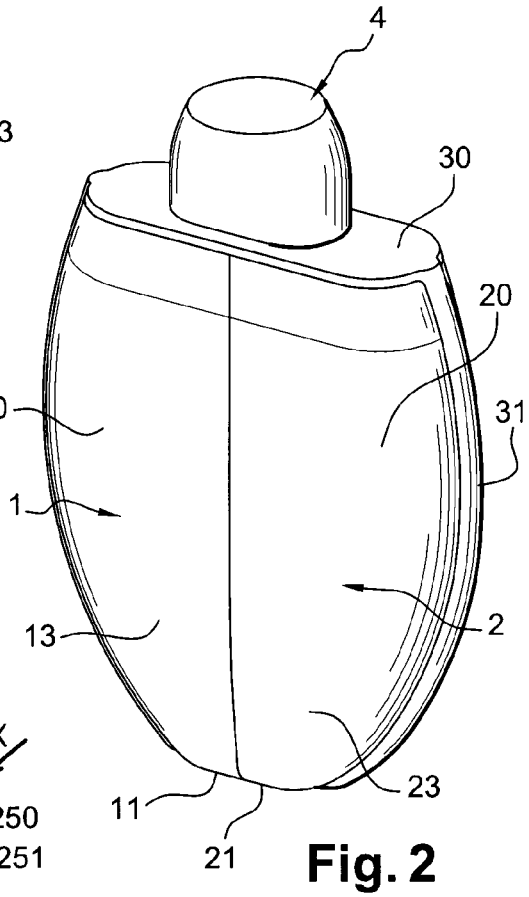
FIG. 2 is a schematic perspective view of the device from FIG. 1 in the assembled state.

With reference to FIGS. 1 and 2, an example of a packaging and application device according to the present invention includes a first container 1, a second container 2 and a coupling device 3. This coupling device includes a coupling means or coupling arrangement 3 that are added on or mounted to make it possible to firmly attach the first and second containers 1 and 2 together.

In the illustrated example, the first and second containers 1, 2 both have an identical configuration. The containers 1, 2 can be produced from an identical or different material. This material can be a polyolefin such as polypropylene, low-density polyethylene or high-density polyethylene, for example. The first and second containers can be produced, for example, by blending by injection blow molding or from various layers of various materials by extrusion blow molding and in particular by coextrusion. As another example, a copolymer of ethylene and acrylic acid or methacrylic acid, such as Surlyn, may also be used.

Such containers 1, 2 are intended to contain a cosmetic and/or care product. Preferably, the containers contain different cosmetic products. The cosmetic products contained in the containers can be products intended to be applied to a surface of the body such as the face and in particular the lips, cheeks, eyelids or nails. These cosmetic products preferably are in liquid, pasty or viscous form. The products contained in the containers may especially be intended to form a lip gloss, an eyeshadow, a care cream, or a foundation. By way of example, the first product can be a liquid foundation and the second product can be a composition comprising flakes or pigments such as nacre. Alternatively, the first product could be a lipstick and the second product a gloss to be applied to the deposited lipstick. As another alternative example, the first and second products could be two lipsticks or two lip glosses of different colors.

The first and second containers 1, 2 include, in this example, a body 10, 20. The first and second containers include, at one end, a base 11, 21. The bases can be provided with a rib 110, 210, the function of which will be explained in the description below. At an opposite end, the first and second containers respectively include a first dispensing orifice 12 and a second dispensing orifice 22. Each container thus includes its own dispensing orifice in this example. The products dispensed will thus only be able to be mixed outside of the respective containers.

The first and second orifices may have an identical or different shape. These orifices may, for example, have a circular shape or a non-circular shape such as an elliptical, polygonal or other shape. Each container could also include several dispensing orifices, such as two, three or more.

Each container body 10, 20 may have any appropriate configuration. For example, the bodies 10, 20 can include a transverse cross section of semi-elliptical shape. The bodies 10, 20 can include a lateral wall 17, 27 that is substantially planar and an opposite lateral wall 18, 28 that is substantially curved. By way of example, the walls can be joined to one another by two actuating walls 13, 14 and 23, 24 respectively. These actuating walls are provided with a certain flexibility so that they can both be deformed by manual pressure exerted by the consumer. This manual pressure then leads to product contained inside the deformed container being dispensed.

As an alternate example, the first and second containers can include a single deformable actuating wall that is used for actuating, such as the wall 13 or 14 for the first container 1 or the wall 23 or 24 for the second container 2.

Figure 3:
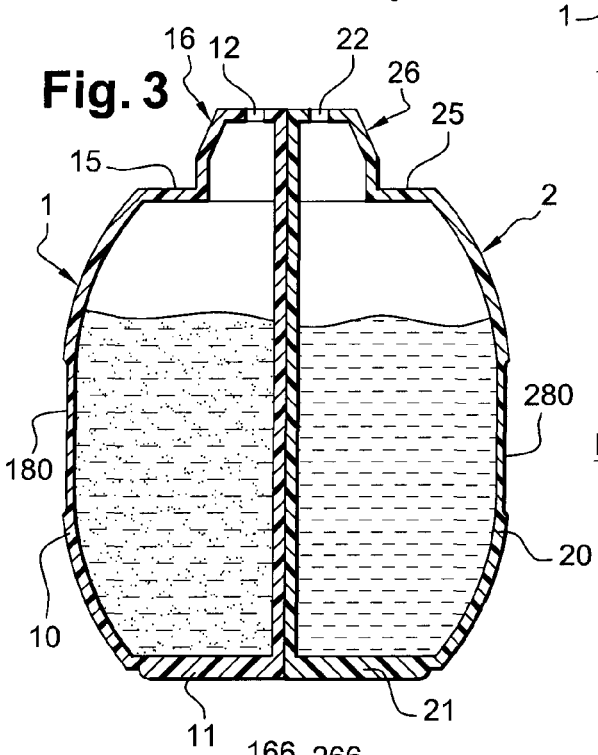
FIG. 3 is a longitudinal cross-sectional view along the X-X plane of one part of the device represented in FIG. 1.

As can be seen in FIG. 3, the first container 1 may be free of any added-on or separate dispensing system, with the dispensing of product resulting solely from the manual deformation of the container body in this example. It is the same for the second container 2. The first and second containers 1, 2 are also configured in order to be able to be actuated independently of one another in the illustrated example.

In this example, the first and second containers 1, 2 include first and second application means or nozzles 16, 26 respectively that define a first and a second application surface 162, 262 respectively. The first and second application surfaces may be common or different. They may be coplanar or extend in different parallel or secant planes, for example.

According to a first aspect of this example, the first and second dispensing orifices 12, 22 open separately into the first application surface 162 and the second application surface 262 respectively. Thus, the device includes a surface that borders and/or covers the first and second orifices and that is able to come into contact with a keratinous surface, such as the skin or the hair, in order to spread the cosmetic or care product.

By way of example, several criteria, considered independently of one another or in combination, may define what is understood or provided by application surfaces. First, such application surfaces should be suitable for applying of product to a keratinous surface such as the skin or the hair. Each orifice may, for example, have a diameter, or a segment having a larger dimension, for example between 0.2 to 10 mm and preferably between 0.5 and 2 mm. Such orifices may be distant or spaced from one another. For example, the orifices can be spaced apart from one another at a distance between 2 mm and 10 mm. Generally, by way of example the space e between these orifices, considered from one edge delimiting it or from its center, may be at least greater than the radius of a dispensing orifice. Advantageously, this space is greater than the diameter, or where appropriate, a segment having a larger dimension, of a dispensing orifice. The space between two orifices may, for example, be at least two times greater than the diameter of a dispensing orifice, and in particular at least five times or ten times greater or more. Such a space enables the application of one product in isolation or in the form of a mixture.

By way of example, the application surfaces 162, 262 can be delimited by a peripheral edge 1620, 2620. Such a peripheral edge can optionally form a ridge between a top application surface and a portion that forms a stack 161, 261. This peripheral edge can be spaced apart at all points, or for some points, from an edge that delimits a dispensing orifice by a distance d having a dimension at least greater than the radius of this orifice, or even at least greater than the diameter, or where appropriate a segment having a larger dimension, of this orifice. Such a distance enables the application of a product in isolation or in the form of a mixture.

The orifices can respectively extend over an area, for example, between 0.03 $mm^2$ and 80 $mm^2$, and more preferably between around 0.2 and 4 $mm^2$, whereas the area of the application surface 162, 262 can be, for example, between 10 $mm^2$ and 1000 $mm^2$, and preferably between 10 and 50 $mm^2$, and more preferably approximately or about 20 $mm^2$. Generally, the orifices can occupy an area strictly less than the application surface. This ratio r, in particular, can be for example on the order of 1/10, 1/100, or even 1/1000. Such a ratio allows the application of a product in isolation or in the form of a mixture.

The space e, this distance d and/or this ratio r thus provide a surface compatible with a product application.

The first and second application means or application surfaces or members 16, 26 are advantageously independent of one another. The first and second containers 1, 2 may thus form two separate dispensing and application units. As will be mentioned in the remainder of this description, at least one nozzle can form an applicator or application means itself or may support respective applicators or application means associated therewith.

As can be seen in the example of FIG. 3, the first and second application members or means 16, 26 and their respective container body 10, 20 can be produced as a single part. According to another example which will be explained in further detail with reference to FIG. 14*c*, the first and second application means or applicators 16, 26 can be added onto their respective container body 10, 20.

According to another example which will be explained in further detail with reference to FIG. 22, the first and second application means or applicators 16, 26 can be produced at a common nozzle suitable for mounting the first and second container bodies 10, 20.

According to another example which will be described in detail subsequently, the first and second application means or applicators can be formed by the coupling means or coupling device of the first and second containers. As a further example or variant, they may also be formed by an application member added onto the coupling means.

Such first and second application means or application members or surfaces 16, 26 can thus be arranged so as to overhang the first and second container bodies 10, 20 respectively.

The first and second application means can then project relative to the bodies 10, 20 respectively. More particularly by way of example, the bodies 10, 20 can both have a shoulder 15, 25 from which the first and second application means 16, 26 respectively stand up. Such application means or surfaces can have a transverse cross section having a smaller dimension than the transverse cross section of their respective body 10, 20.

As can be seen in the example of FIG. 1, the application means or surfaces 16, 26 can include substantially planar lateral surfaces 163, 263. This lateral surface can extend into the (or as a) continuation of the side walls 17, 27 respectively of the container. In other words, the lateral surfaces 163, 263 of the application means 16, 26 can extend in one and the same plane as the lateral walls 17, 27 respectively of the containers.

The lateral surface 163 of the first container 1 can have a shape complementary to the lateral surface 263 of the second container 2. In such a case, the lateral surfaces of the first container 1 and of the second container 2 may then perfectly fit with one another. According to a variant illustrated in FIG. 5, the lateral surfaces 163, 263 could have a curved or wavy profile.

Figure 6:
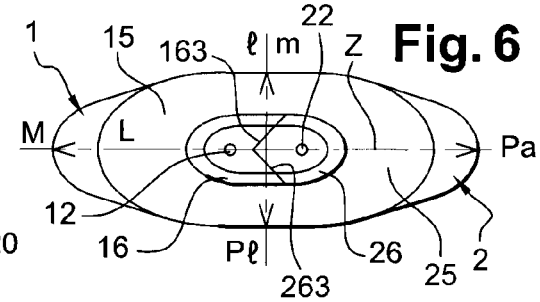
FIG. 6 is a schematic top view of one embodiment of a device according to the invention.

According to another variant illustrated in FIG. 6, the lateral surfaces 163, 263 could have a triangular profile.

In this example of an embodiment, the first and second application means have a respective base part 160, 260 and a respective top part 161, 261.

By way of example, the base part 160, 260 can extend perpendicularly from the shoulder 15, 25. This base part can have a transverse cross section of circular, square, rectangular, elliptical or other shape.

The top part 161, 261 stands up from the base part 160, 260. This top part 161, 261 may form the first and second application surfaces 162, 262 respectively. This top part is thus configured to enable the application of the product dispensed through the first and second dispensing orifices 12, 22.

The first and second containers 1, 2 can be placed side by side over their entire height in the illustrated examples. The first application means or surfaces 16 may then be placed side by side with the second application means or surfaces 26. More precisely, the lateral surfaces 163, 263 can come into contact with one another. Similarly, the container bodies 10, 20 can both be placed side by side. More precisely, the lateral walls 17, 27 may be in contact with one another.

The first and second application surfaces 162, 262 can come into contact with one another so as to define a substantially continuous application surface. In this case, the first and second application surfaces are joined to one another discretely or continuously. They may be flush with one another.

Figure 7:
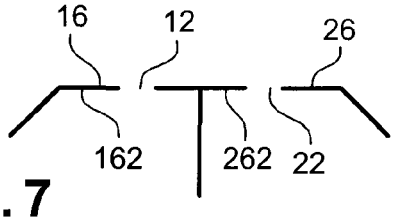
FIG. 7 is a schematic longitudinal cross-sectional view of one embodiment of one part of the device according to the invention.

As shown in the example of FIG. 7, the first and second application surfaces 162, 262 can be planar.

Figure 8:
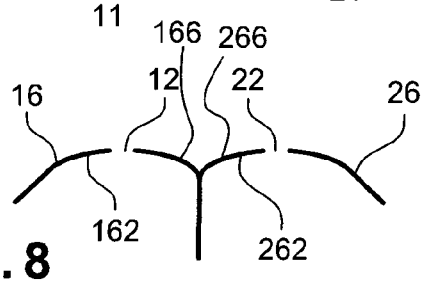
FIG. 8 is a schematic longitudinal cross-sectional view of one embodiment of one part of the device according to the invention.

As shown in FIG. 8, the first and second application surfaces 162, 262 can also be wavy or dented. Such surfaces may together define a common surface for receiving product in the form of a basin 166, 266 that makes it possible, for example, to visualize the product before application or even to facilitate the application of the product or products dispensed especially when the surface to be made up, such as the lips, includes reliefs. Thus, a portion or basin can be provided near the outlet orifices to allow a quantity of the product to be seen before application.

Figure 9:
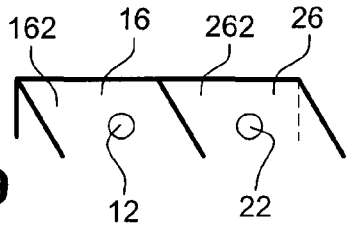
FIG. 9 is a perspective view of one embodiment of one part of the device according to the invention.

As shown in the example of FIG. 9, the first and second application means 16, 26 can be beveled so that the first and second application surfaces 162, 262 are planar.

Figure 10:
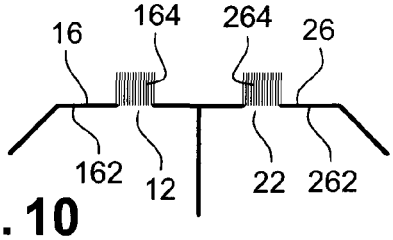
FIG. 10 is a schematic longitudinal cross-sectional view of one embodiment of one part of the device according to the invention.
Figure 11A:
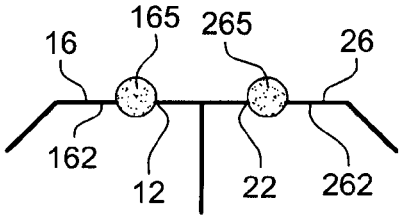
FIG. 11*a* is a schematic longitudinal cross-sectional view of one embodiment of one part of the device according to the invention.

As shown in the example of FIGS. 10 and 11*a, b, c, d* and *e*, it is also possible to provide first and second application means or surfaces 16, 26 that extend beyond the first and second application surfaces 162, 262.

In FIG. 10, the applicators such as first and second application means or surfaces 16, 26 include a combing member 164, 264. Such a combing member can include a plurality of teeth that extend around the first and second dispensing orifices 12, 22.

In FIG. 11*a*, the first and second application means or surfaces 16, 26 include a porous or fibrous member 165, 265, where appropriate, which can become saturated with a product such as a woven material, nonwoven or a foam. These application means can be arranged opposite the first and second dispensing orifices 12, 22, or even extending through the first and second dispensing orifices 12, 22. Such applicators or application means can be mounted in a stationary or movable, especially rotational, manner in the first and second dispensing orifices.

Figure 11B:
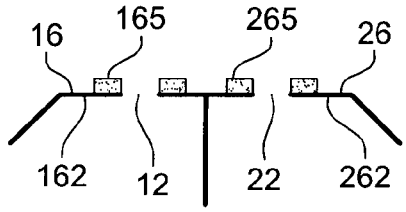
FIG. 11*b* is a schematic longitudinal cross-sectional view of one embodiment of one part of the device according to the invention.

In FIG. 11*b*, the first and second applicators or application means extend around the first and second dispensing orifices. This application member can thus include a cut-out or opening positioned opposite an orifice. Such application means may, for example, be in the form of a porous member.

Figure 11C:
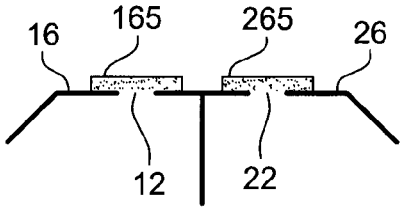
FIG. 11*c* is a schematic longitudinal cross-sectional view of one embodiment of one part of the device according to the invention.

In FIG. 11*c*, the first and second applicators or application means each include a porous member 165, 265 that covers the first and second dispensing orifices. These application means may be spaced apart from one another.

Figure 11D:
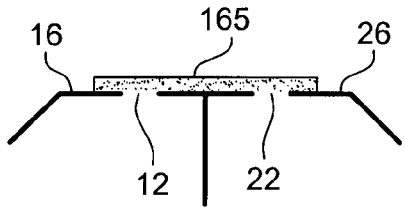
FIG. 11*d* is a schematic longitudinal cross-sectional view of one embodiment of one part of the device according to the invention.

In FIG. 11*d*, the first and second applicators or application means include a single application member that covers the first and second dispensing orifices. This application member is then able to be impregnated with product. The dispensing of product from a container can translate into the selective impregnation of one part of the application member or of substantially all of the application member. This dispensing may give rise to the creation of a concentration gradient of product dispensed within the application member. This concentration of product dispensed may, for example, be stronger opposite the dispensing orifice than laterally.

Figure 11E:
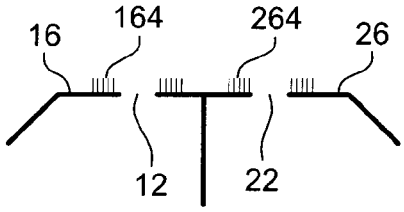
FIG. 11*e* is a schematic longitudinal cross-sectional view of one embodiment of one part of the device according to the invention.

In FIG. 11*e*, the first and second applicators or application means include a flocking 164, 264, for example arranged around the first and second dispensing orifices.

It should be noted that, in accordance with a further example of the invention, the first and second applicators or application means can be different in a given device. In addition, it is to be understood that, besides the first and second applicators or application means described, other applicators or application means could also be used.

Figure 14A:
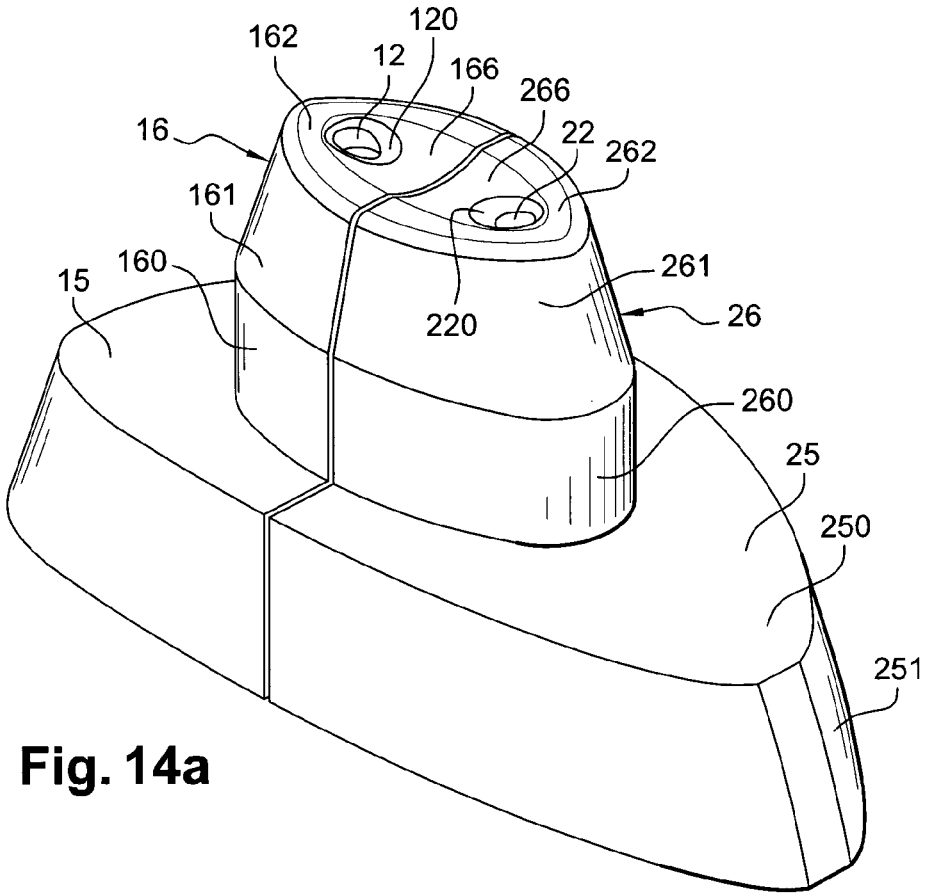
FIG. 14*a* is a schematic perspective view of an alternate embodiment or variant of one part of the device according to the invention.

As can be seen in the example of FIG. 14*a*, the first and second applicators or application means can be provided with a respective concave portion 166, 266. The orifices 12, 22 may both open into this concave portion. During coupling of the first and second containers, these concave portions may together define a common basin 166, 266. This basin can retain the cosmetic or care product exiting the dispensing orifices. Such a basin thus makes it possible to facilitate the observation of the product dispensed before application. In such a case, the application surfaces 162, 262 can be formed by the basin itself and/or by a peripheral portion of this basin 166, 266, which, for example, can be annular. The bottom of the basin can be provided level with an assembly portion of the first and second containers.

Figure 14B:
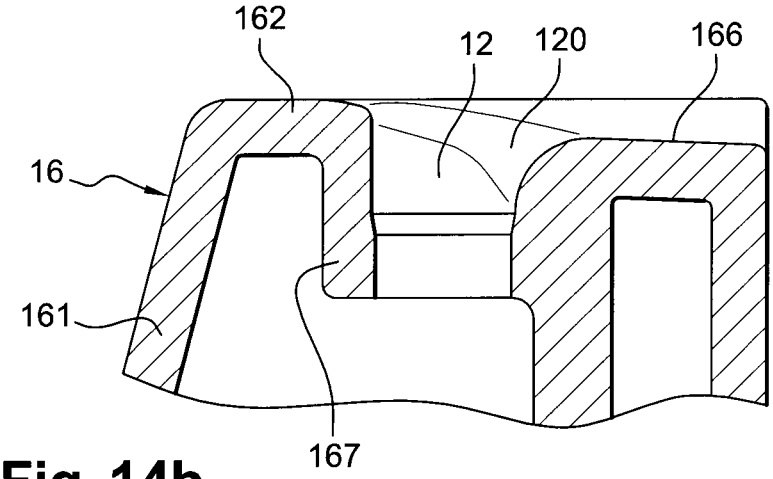
FIG. 14*b* is an enlarged longitudinal cross-sectional view of one part of the device represented in FIG. 14*a;*
Figure 14C:
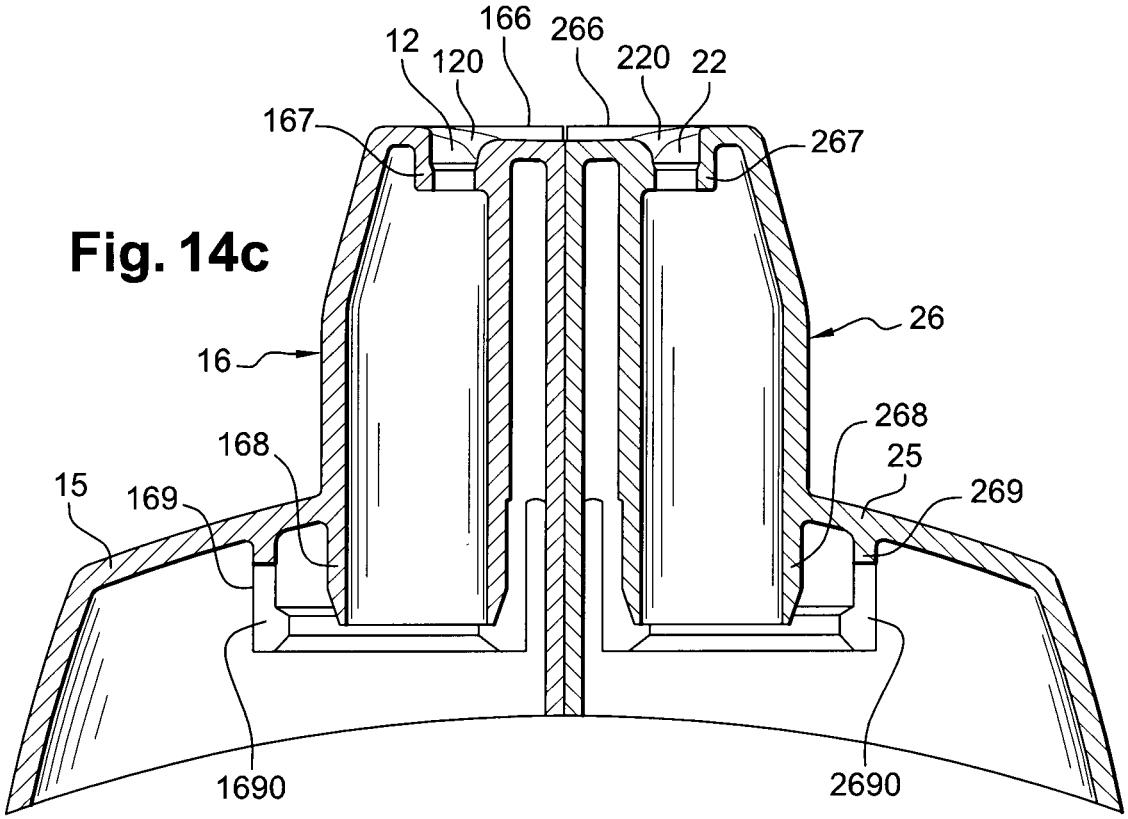
FIG. 14*c* is a schematic longitudinal cross-sectional view of the part of the device represented in FIG. 14*a;*

As can be seen in FIG. 14*c*, the nozzles 16, 26 can both include a mounting skirt 168 and a retaining skirt 169. Each retaining skirt can include an attachment arrangement or attachment means 1690 to firmly attach the first and second containers to their nozzle. These attachment means can, for example, include snap-fastening means, for example in the form of a ridge or legs.

The first and second container bodies, not shown, can themselves respectively include a neck that has a shoulder defining a mouth. This mouth can include an inner face able to be tightly gripped with the mounting skirt 168 and an outer face able to cooperate with the retaining skirt. This outer face can, for example, include a snap-fastening means or arrangement complementary to those provided on the retaining skirt, for example produced in the form of one or more reliefs, such as an annular rib or protuberance. Other ways of assembling or fastening/attaching the container bodies to their respective applicators or application means can alternately be utilized.

The dispensing orifices can communicate with the inside of the first and second containers by a dispensing duct or flow limiter 167, 267 respectively. In the illustrated example, such ducts have a transverse cross section with a smaller dimension than that of the container bodies and smaller than that of the application means. These ducts can have a transverse cross section with a variable dimension. In particular, the ducts can include an outer annular projection. This annular projection can form a flared or frustoconical portion 120, 220 located at the exit of the duct level with the dispensing orifice 12, 22. FIG. 14*b* represents an enlarged view of the flared portion 120 of the dispensing orifice.

Each orifice 12, 22 can be inclined toward the bottom of the basin. Thus, the orifices of the first and second containers can be oriented toward one another. The product dispensed through these orifices is then better directed toward the bottom of the basin 166, 266. Each orifice can be delimited by an edge having a lower axial height on the side of the bottom of the basin so as to best orientate the product dispensed in its direction.

Figure 19A:
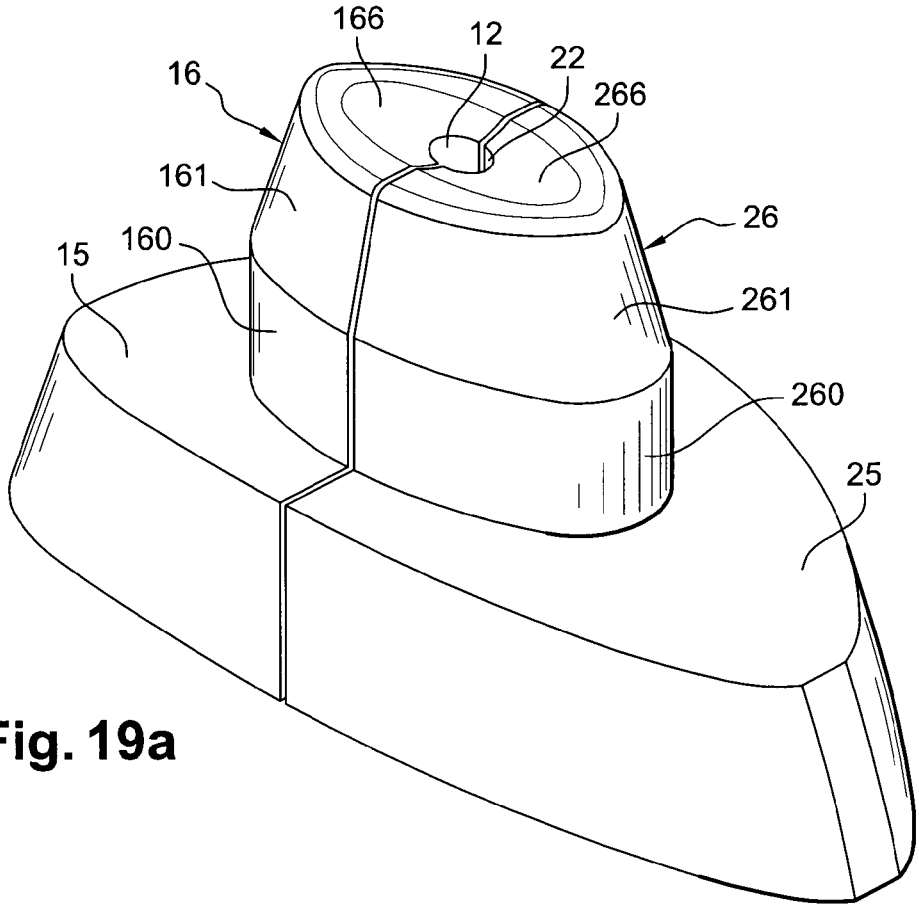
FIG. 19*a* is a schematic perspective view of another embodiment or variant of one part of the device according to the invention.
Figure 19B:
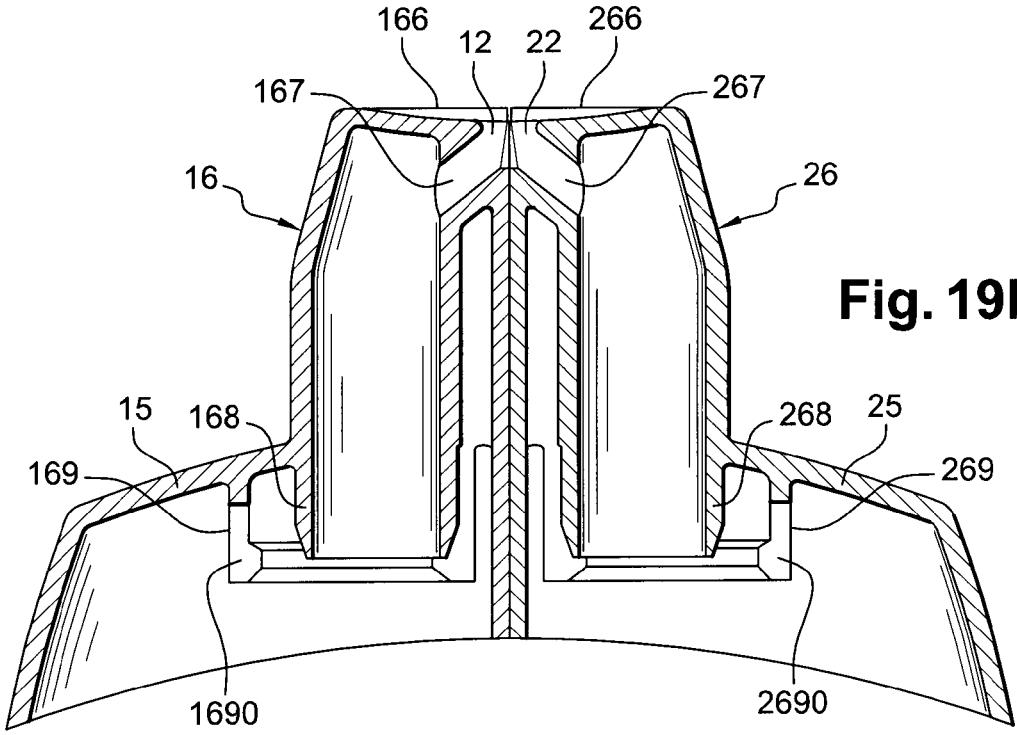
FIG. 19*b* is a schematic longitudinal cross-sectional view of the part of the device represented in FIG. 19*a;*

The embodiment represented in FIGS. 19*a*, 19*b* differs from the embodiment described with reference to FIGS. 14*a*, *b* and *c*, in that the dispensing ducts 167, 267 are oriented toward one another. In other words, such ducts can converge toward one another. These ducts can join together level with the main axis of elongation of the device. These dispensing ducts open separately into two dispensing orifices 12, 22. After assembly, the ducts and their respective dispensing orifice are joined together. These orifices can optionally open into a basin 166, 266.

The first and second containers 1, 2 are joined to one another by a coupling arrangement or coupling means 3 that are added on.

In the illustrated embodiment represented in FIG. 1 by way of example, the coupling means 3 can include a collar 30, two branches 31, a crown 32 and a strut 33.

The coupling means form a cut-out intended to at least partly surround the first and second containers 1, 2. This cut-out can, for example, be produced from a metal or plastic material. For example, one such cut-out can be produced from a polyolefin and especially from low or high density polyethylene, from a thermoplastic elastomer such as Santoprene or from an elastomer.

The collar 30 includes an opening 300, which is preferably in the center of the collar, through which the applicators or application means 16, 26 may extend. Such a collar can thus surround one part of the first and second application means 16, 26. This collar can come to rest against the shoulder 15, 25 of the first and second containers 1, 2. It may have a general shape identical to or substantially the same as that of the shoulders 15, 25.

This collar has two opposite curved edges from which the branches 31 extend. These branches have a substantially arched configuration in order to conform to the shape of the curved walls 18, 28. Such branches surround the curved walls 18, 28 while leaving the actuating walls 17, 27 directly accessible for the user. Advantageously, the branches come into close contact against the curved walls of the first and second containers so as to constrain the first and second containers against one another.

As can be seen in FIG. 1, the branches 31 can include an inner face provided with at least one relief 311 able to cooperate with a complementary relief 180, 280 of the first and second containers. Such reliefs can respectively include a longitudinal rib 311 able to cooperate with a corresponding groove recess 180, 280 or vice versa.

The branches 31 can include an end 310. In the mounted position of the coupling arrangement or coupling means, these ends can extend beyond the base 11, 21 of the first and second containers.

By way of example, as represented in FIG. 1, the branches may be joined to one another by the strut 33. The strut 33 can include a groove 330. Such a strut can, for example, join together the ends 310 of the branches themselves. This strut can extend under the bases 11, 21 of the first and second containers. Such a strut may fit in a tightly gripping fashion under the bases. It may then force or hold the first and second containers 1, 2 and in particular the shoulders 15, 25 such that they come to rest against the collar 30.

According to one advantageous embodiment by way of example, the ribs 110, 210 of the first and second containers can fit, for example snap-fasten, into the groove 330 of the coupling arrangement. According to an alternate example not illustrated, the groove could be provided in the first and second containers and the rib on the strut.

According to an alternate example not illustrated, the strut 33 could be replaced by flanges, such as radial flanges, extending from their respective branch 31 which are at a distance or spaced from one another. Such flanges could be oriented or extend in a direction toward one another.

According to another alternate example not illustrated, the coupling means could optionally be free of a strut 33. In such a case, the coupling means can have a general upside down U-shape. The branches 31 can form a flexible part of the coupling means. For example, the branches 31 can have a high shape memory or elasticity to return, or be biased to a position gripping the containers. Such branches can be displaced angularly relative to the collar 30. The branches may then tightly grip around the first and second containers 1, 2. Such a flexibility enables, on the one hand, easier assembly and disassembly of the containers and, on the other hand, makes it possible to elastically constrain or hold the containers in contact with one another.

The crown 32 stands up from the collar 30 in the illustrated example. This crown can, for example, extend from the edges of the opening 300 of the collar 30. This crown extends, relative to the collar 30, in an opposite direction to the branches 31.

This crown 32 can have a shape and a size suitable for keeping the first and second application means against one another. Such a crown is advantageously able to tightly grip around the base parts 160, 260 of the first and second applicators or application means. In this example, the first and second containers 1, 2 are therefore assembled such that they are closely fitting together in the collar.

Figure 15A:
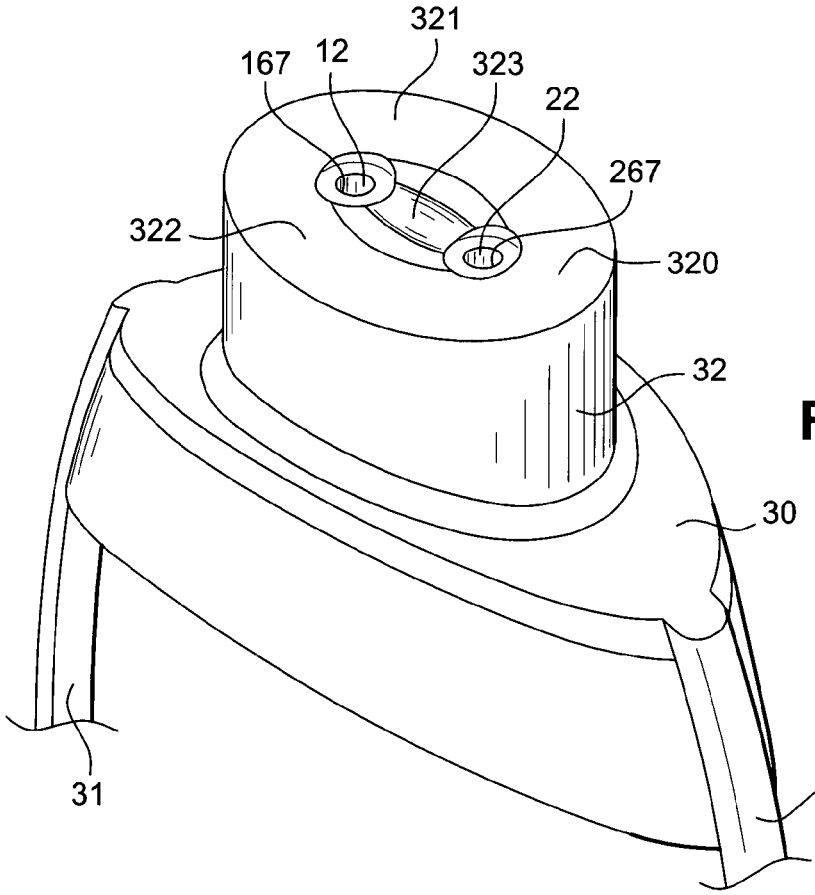
FIG. 15*a* is a schematic perspective view of another embodiment or variant of one part of the device according to the invention.
Figure 15B:
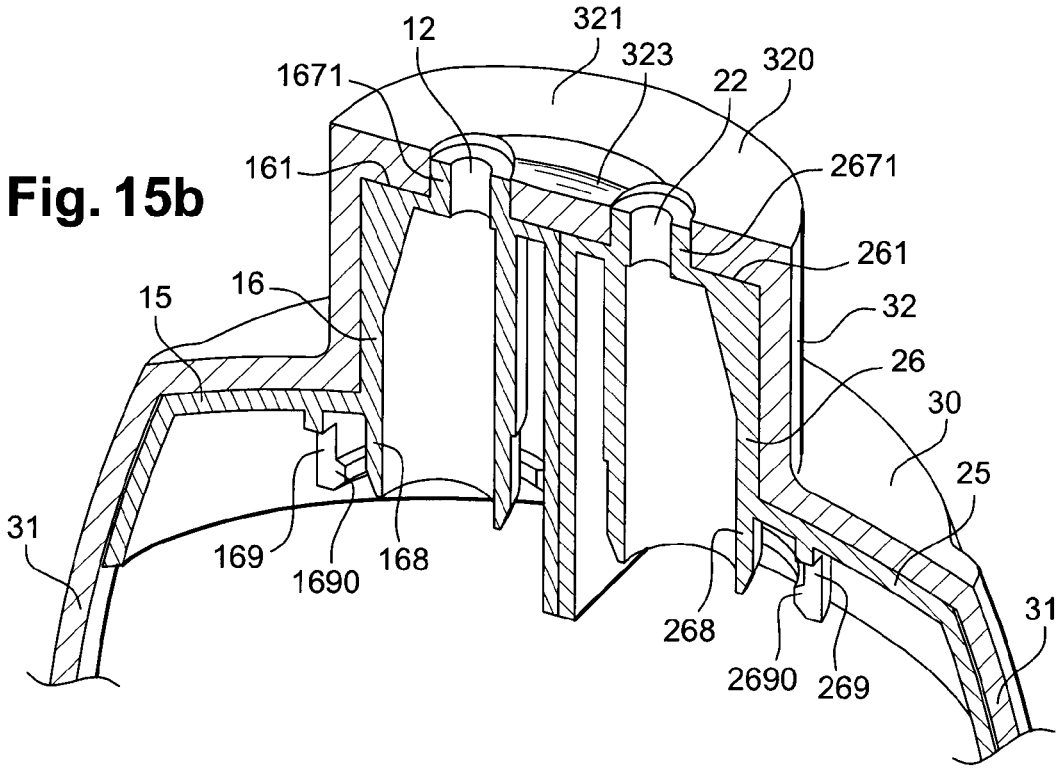
FIG. 15*b* is a schematic longitudinal cross-sectional view of the part of the device represented in FIG. 15*a;*

According to an example shown in FIGS. 15*a* and 15*b*, the dispensing orifices 12, 22 may project relative to the nozzle and in particular relative to the surfaces 162, 262, as represented by projecting portions 1671, 2671 (FIG. 15*b*). In such a case, the coupling arrangement or coupling means 3 may be tightly gripped, for example by close fitting, around the dispensing ducts 167, 267.

The crown 32 can be surmounted by a cover 320. This cover can include, for example, two openings able to be positioned opposite or about the first and second dispensing orifices. The edges that delimit these openings can tightly grip around the first and second dispensing orifices or the ducts or projections associated with the orifices.

By way of example, the cover 320 can extend along a plane inclined relative to the axis of elongation of the device. This cover can extend along a plane inclined relative to the surfaces 162, 262 and/or along a plane inclined relative to the dispensing orifices 12, 22. By way of example, the applicators or application means can have an inclination between 0 and 45°.

The cover 320 can thus include a first portion 321 raised up relative to the orifices 12, 22 and a second portion 322 that is flush with or subjacent or below these orifices. This second portion may, for example, allow the product dispensed to flow over it before the user spreads it onto a keratinous surface, such as the lips or the hair for example. For example, the cover 320 can include, between the dispensing orifices 12, 22, a basin 323.

Figure 15C:
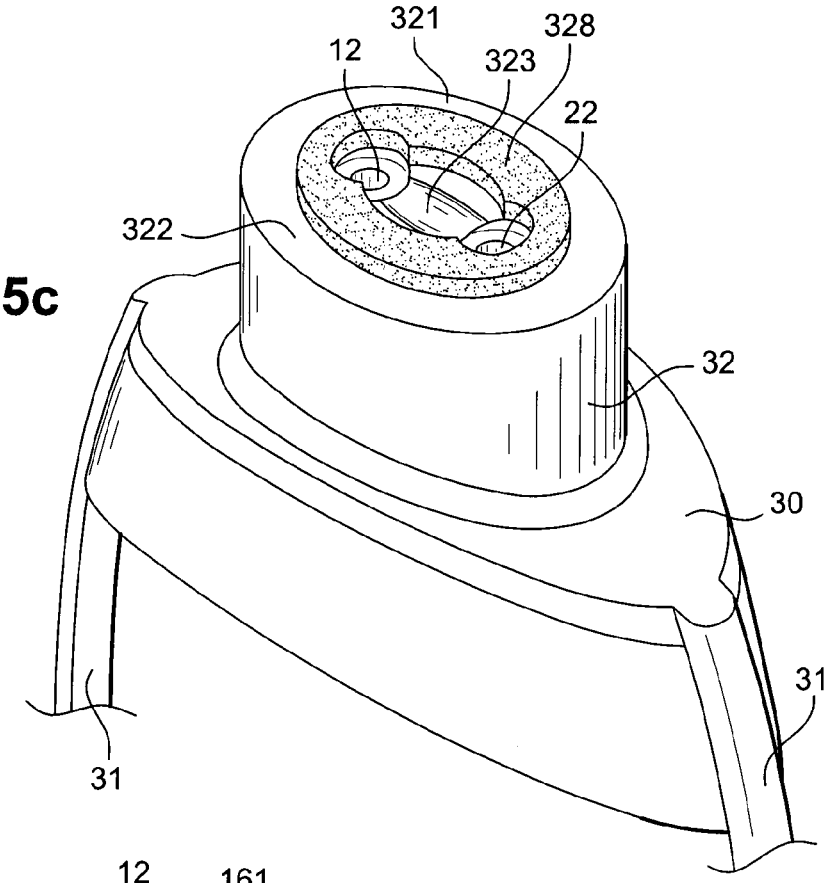
FIG. 15*c* is a schematic perspective view of another embodiment or variant of one part of the device represented in FIG. 15*a;*

The cover 320, as it is, can act as or provide an applicator or application means (or a portion of application means) for the product dispensed. Alternatively, an application member, such as described previously, can be added onto or through the first and second dispensing orifices or an additional application member can be provided as part of the cover. In FIG. 15*c*, a porous member such as a foam is provided in order to apply the product dispensed through the dispensing orifices. This foam may, for example, be attached around the dispensing orifices and where appropriate around the basin 323. This member could also cover at least one of or both of the dispensing orifices.

Figure 16:
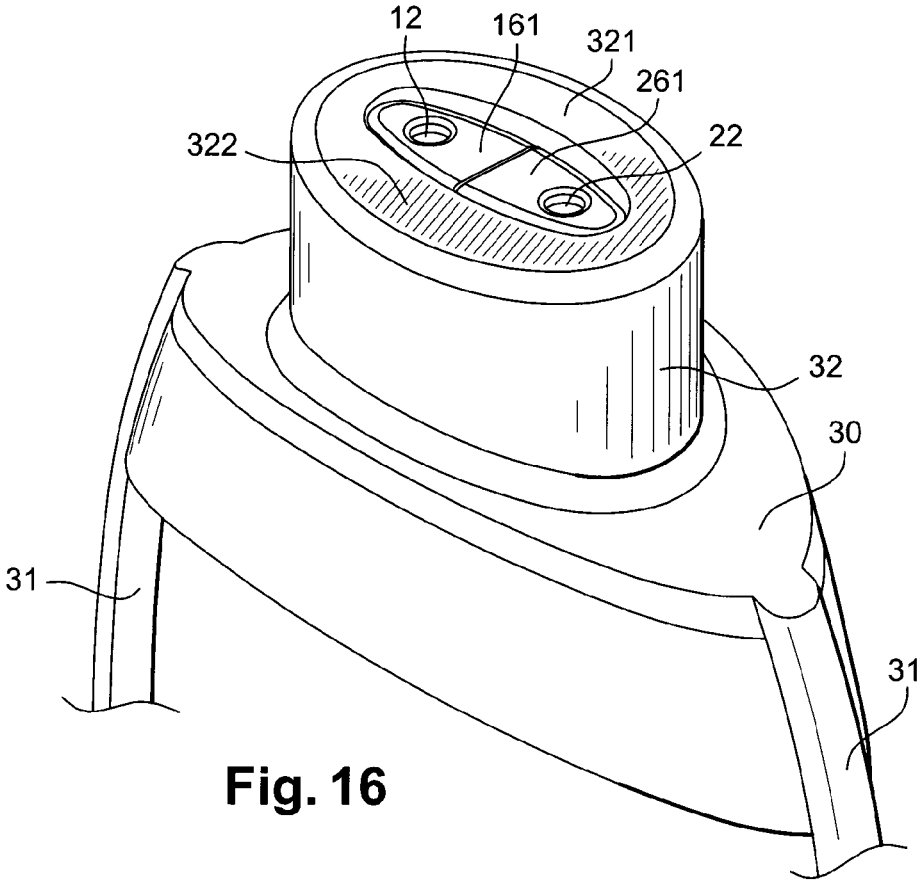
FIG. 16 is a schematic perspective view of another embodiment or variant of one part of the device according to the invention.

The embodiment represented in FIG. 16 differs from the embodiment described with reference to FIG. 15*a* in that the cover 320 includes an opening that is positioned opposite or adjacent a plurality of dispensing orifices 12, 22. This cover may thus have a generally annular shape. In this embodiment, the dispensing orifices do not project relative to the application surfaces 162, 262. A basin made in the application surfaces 162, 262 could optionally be provided between the dispensing orifices 12, 22.

Figure 17:
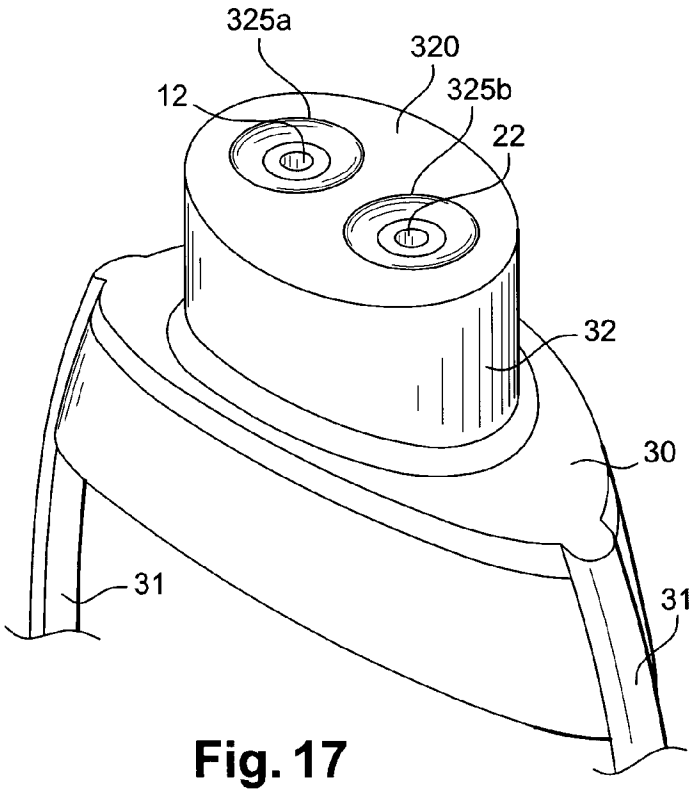
FIG. 17 is a schematic perspective view of another embodiment or variant of one part of the device according to the invention.

The embodiment represented in FIG. 17 differs from the embodiment described with reference to FIG. 15*a* in that each orifice 12, 22 opens into a separate basin 325*a*, 325*b*.

Figure 18:
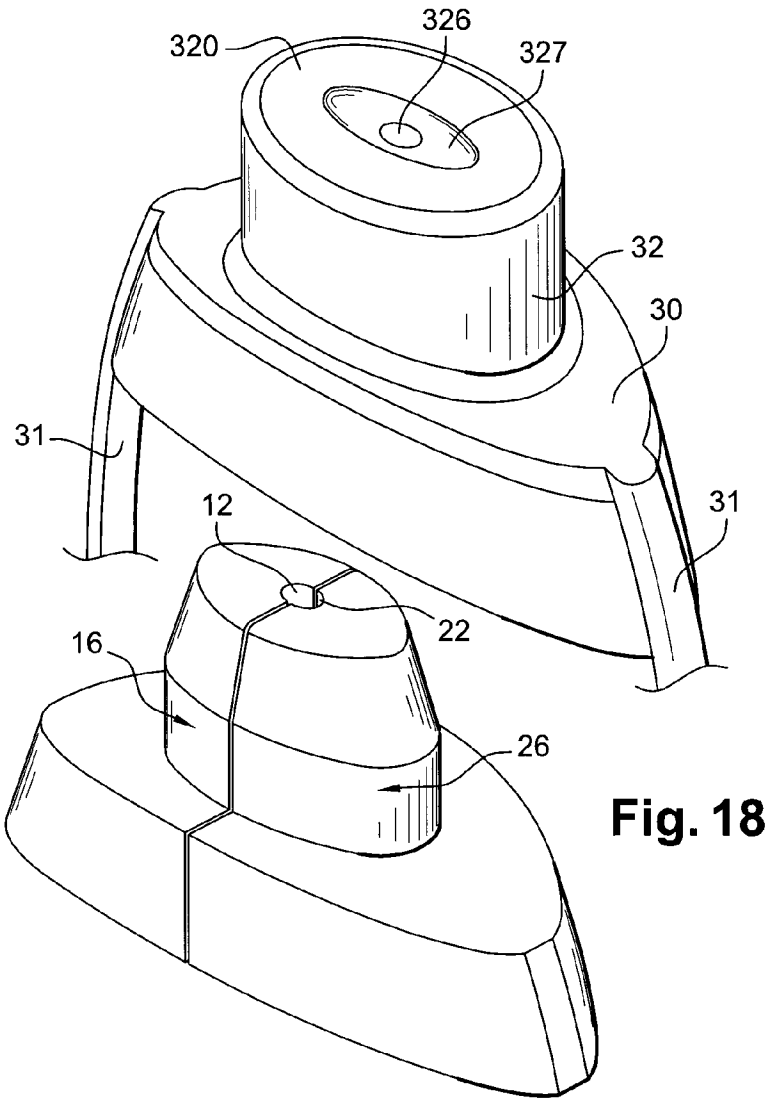
FIG. 18 is an exploded schematic perspective view of another embodiment or variant of one part of a device according to the invention.

The embodiment represented in FIG. 18 shows that a cover 320 may be fitted to a nozzle such as described with reference to FIGS. 19*a*, 19*b*. In the example illustrated, the cover is provided with an opening positioned opposite or adjacent the dispensing orifice. This opening can include a basin 327.

Thus, as should be apparent from the above examples, the coupling means or coupling arrangement, and in particular the cover, can include product application means or application surfaces. In addition, the coupling means, and in particular the cover, may be coated or provided with an application member that is added on such as described previously in order to apply the product or products dispensed.

Figure 4:
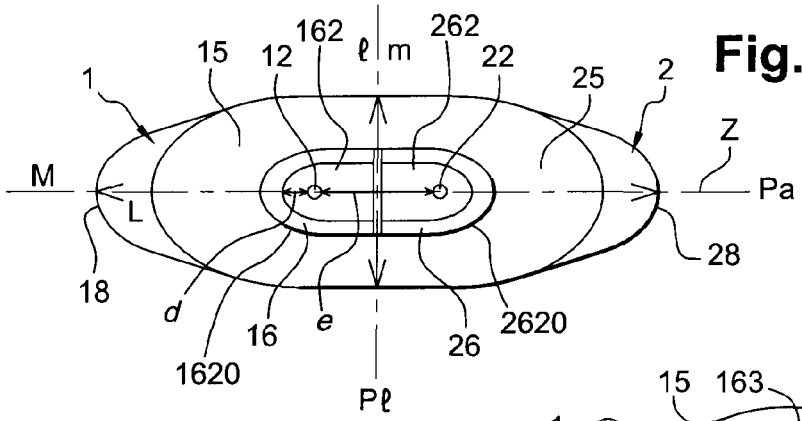
FIG. 4 is a schematic top view of one embodiment of a device according to the invention.

Once coupled, the first and second containers 1, 2 are arranged side by side. The containers may then be positioned one next to the other with their respective base and dispensing orifice oriented in the same manner. In this coupled state and as can be seen in FIG. 4, the device can include, with regard to the first and second containers 1, 2, a transverse cross section having elongated shape that defines a length L and a width 1. This length and this width may respectively extend in a major axis M and a minor axis m of the transverse cross section. Such a transverse cross section may, for example, have an elliptical shape.

Figure 5:
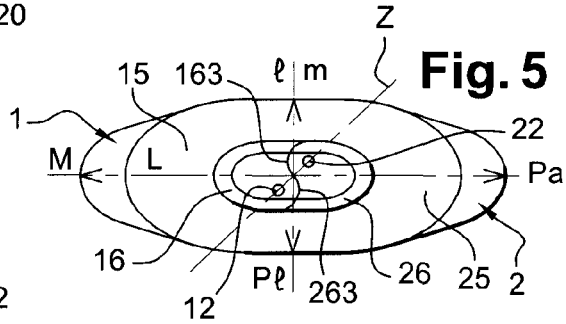
FIG. 5 is a schematic top view of one embodiment of a device according to the invention.

According to a second aspect of the present invention, and as shown in FIGS. 4, 5 and 6 especially, the first and second containers can be coupled in the width of the device. In other words, the first and second containers can be positioned opposite, and especially in contact with, one another, with regard to one respective side of smaller dimension. The first and second containers may be coupled along a coupling or assembly mid-plane P1. Such a plane P1 can be parallel and in particular merged with the minor axis m. As a variant, this plane P1 can extend obliquely to the minor axis m. The dispensing orifices 12, 22 can extend on both sides of this plane P1 as shown. In this example, the plane P1 defines a plane of symmetry of the device.

As represented in FIGS. 4 and 6, the first and second dispensing orifices can extend along an axis Z transverse to the plane P1 of the device. In FIG. 5, these first and second dispensing orifices can extend along an axis Z oblique to the plane P1.

The curved walls 18, 28 of the first and second containers can both be bisected by a main plane of elongation Pa. This plane Pa extends in the length L of the device. This plane Pa cuts or intersects the plane P1, and this for example in a perpendicular fashion. This plane Pa may be parallel, and in particular merged, with the major axis M. Such a plane Pa can also define a plane of symmetry of the device. According to one particular embodiment, the first and second dispensing orifices 12, 22 can extend into this plane Pa. According to one example or alternative, the first and second dispensing orifices can extend along a plane substantially parallel or secant to the plane Pa.

According to one advantage of a device such as described is that the deformable wall of each container is easily accessible. Thus, a user can easily position their fingers on one and/or the other of the containers. Moreover, such an embodiment prevents the actuation of one container from interfering with the other container.

According to one advantageous mode of use of the present invention, the user can grip a container in each hand and simultaneously compress each container in order to simultaneously dispense the first and second products contained inside. Once dispensed, the first and second products can be simultaneously spread and mixed on the desired area of the body. The fact that the user can actuate one container independently of the other container allows the user to dispense the first and second products in different proportions. Thus, the amount of first and second products dispensed will be dependent on the compressive force respectively exerted on the first and second containers.

According to one variant of use, the containers may be actuated alternately. The deformable actuating walls 13, 14 of the first container may thus be compressed first to dispense a first product. The first product dispensed may then be spread using the first application means. Next, the actuating walls 23, 24 of the second container may in turn be compressed to dispense a second product. The second product dispensed may then be spread using the second application means and mixed with the first product.

One advantageous feature of a device according to the examples is that each container can include two opposite lateral walls 17, 18 or 27, 28 that the user cannot actuate, due to their conformation and/or their accessibility. To actuate the device, the user can only actuate the deformable actuating walls 13, 14 or 23, 24 connecting the two opposite lateral walls.

Figure 21A:
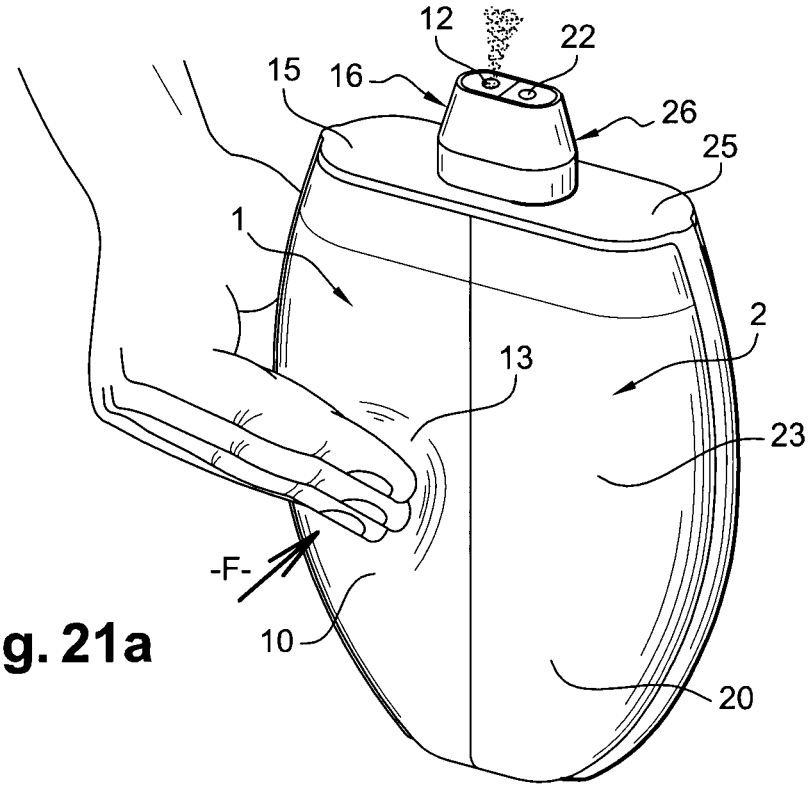
FIG. 21*a* is a schematic perspective view of one operating mode of a device according to the present invention.
Figure 21B:
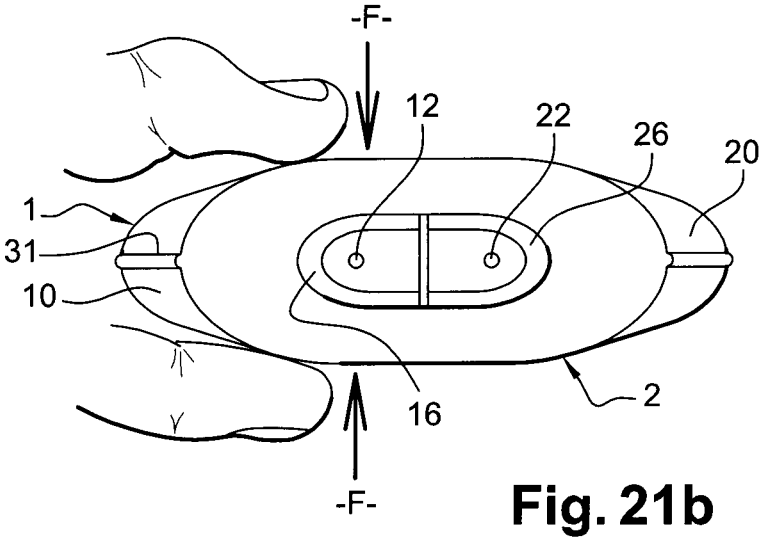
FIG. 21*b* is a schematic top view of one operating mode of a device according to the present invention.

As illustrated in FIGS. 21*a* and 21*b*, in order to dispense a product contained in a container, the user may exert an actuating or compressive force (F) by simultaneously squeezing the wall 13 of the first container 1 using their thumb and the wall 14 of the same container using their index finger and optionally their middle finger. This force can be exerted in a direction that is not secant to the second container 2. In other words, this force is not oriented in the direction of the second container. This force can be exerted in a direction substantially parallel to the coupling mid-plane of the first and second containers. It can also be exerted in a direction substantially orthogonal to a product dispensing axis. Thus, such a movement provides a sure and reliable means for dispensing the products from each container independently of one another.

Figure 20:
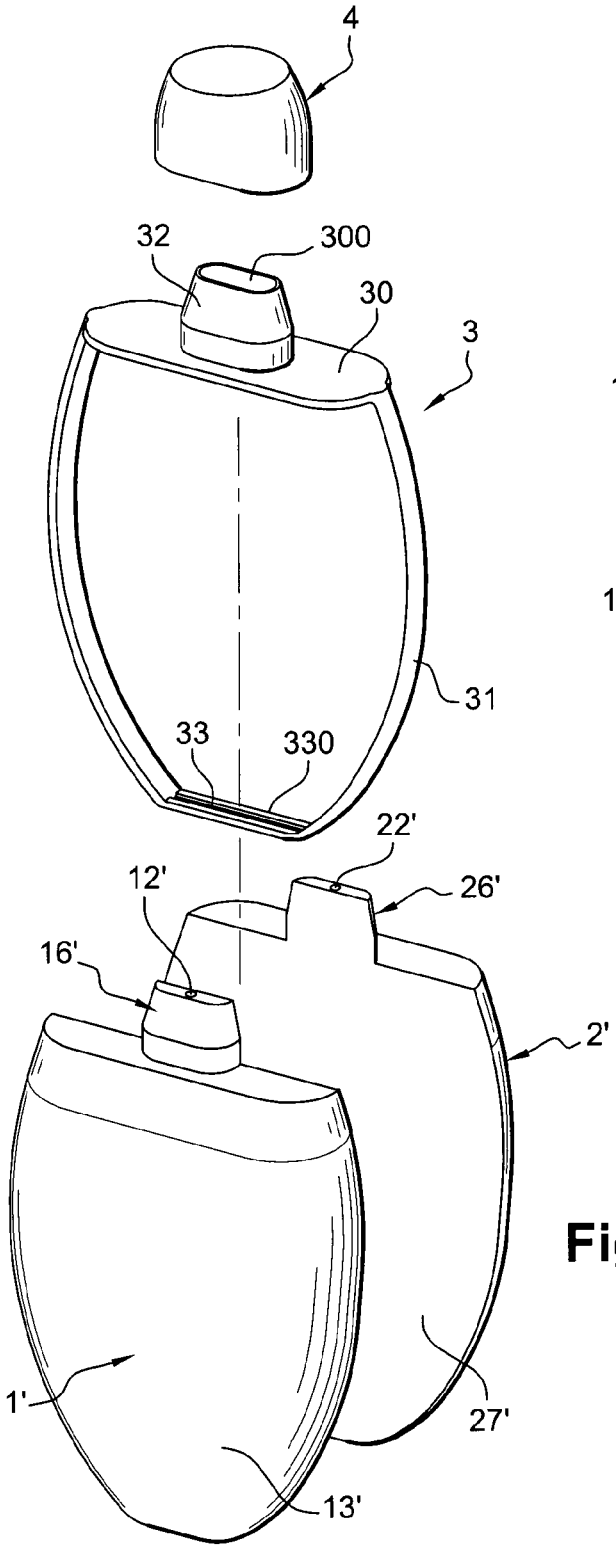
FIG. 20 is an exploded schematic perspective view of another embodiment of a device according to the invention.

According to one variant or alternate example illustrated in FIG. 20, the first and second containers can be coupled along the length or larger dimension of the width of the device. In other words, the first and second containers can include one side having a larger dimension extending opposite, and preferably in contact with, one another. The containers can be coupled along an assembly mid-plane substantially parallel, or even merged, with the major axis M of the transverse cross section of the device.

Figure 22:
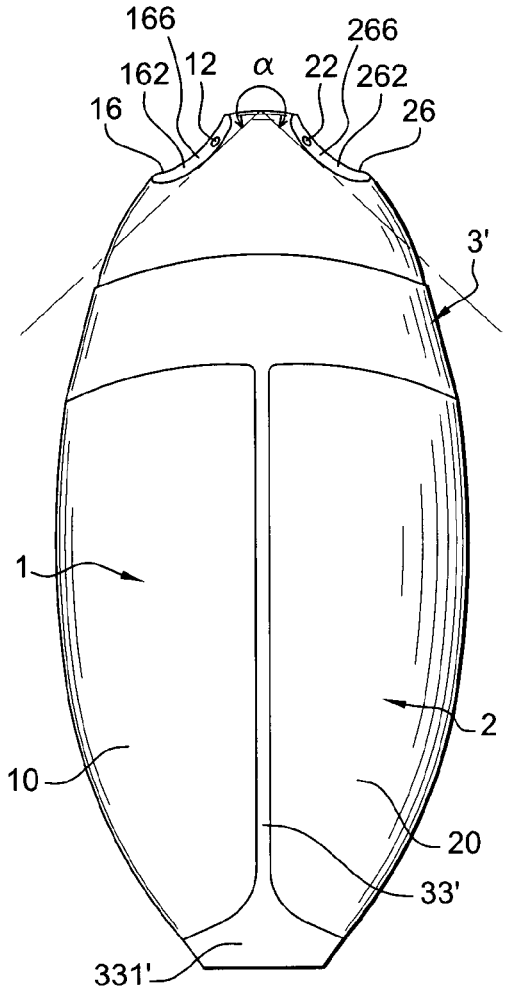
FIG. 22 is a schematic perspective view of another embodiment or variant of a device according to the invention.

According to an alternate embodiment or variant illustrated in FIG. 22, each orifice can open into a respective concave portion or basin 166, 266. It can also be seen that the application surfaces 162, 262 can extend along two separate planes P1, P2. These planes can be secant to one another. They may, for example, together define an angle $\alpha$ greater than 180°.

Furthermore, as shown in FIGS. 1 and 2, the first and second application means or applicators can be covered by a cap 4. This cap may, for example, tightly grip around the first and second application means 16, 26 or around the hollow body 32.

Figure 12:
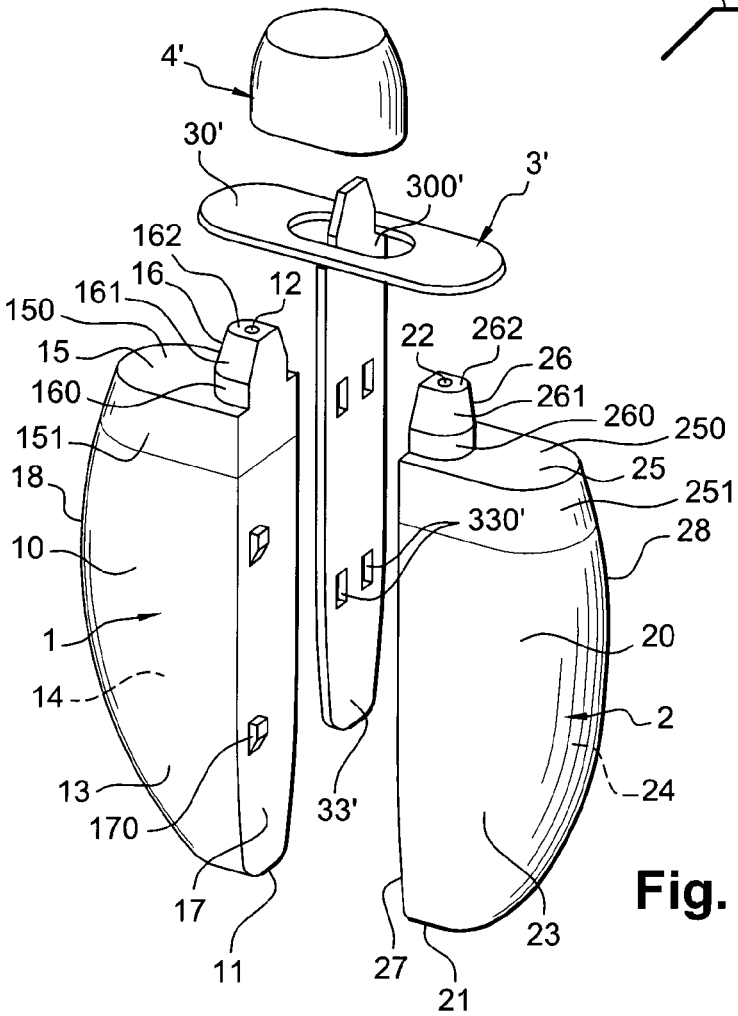
FIG. 12 is an exploded schematic perspective view of another embodiment of a device according to the invention.
Figure 13:
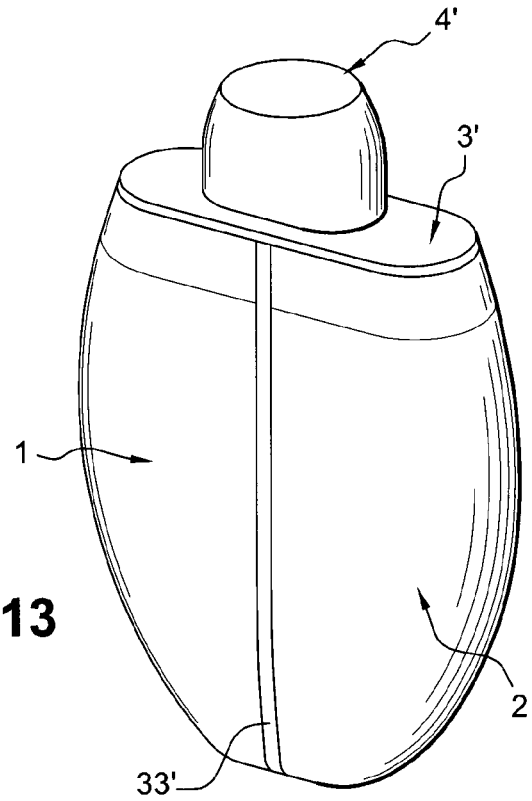
FIG. 13 is a schematic perspective view of the device of FIG. 12 in the assembled state.

FIGS. 12 and 13 show another embodiment of a device according to the invention. These figures represent, in particular, an example of an alternate embodiment of the coupling means or coupling arrangement, referenced 3'. Specifically, in this case, the coupling means or coupling arrangement 3' includes a collar 30' and a plate 33'. These coupling means have, in this example, a general T-shape. As illustrated in FIG. 12, this collar and this plate can be produced as a single part. As a variant, this collar and this plate could be formed from two separate parts joined to one another by any suitable means.

The plate 33' can extend on both sides of the collar 30'. This plate can thus split the opening 300' into two openings. The plate 33' can include orifices 330'.

In this embodiment, the side walls 17, 27 of the containers themselves include an attachment or attachment means which cooperate with the plate 33'. Such attachment means can, for example, include snap-fastening legs or protuberances 170. Each side wall can, for example, include two snap-fastening legs. These snap-fastening legs can extend at various heights from the side walls 17, 27.

In order to couple the first and second containers together, the first and second application means 16, 26 (and their associated outlets) are inserted through the openings 300' of the collar. The plate 33' then extends between the first and second containers 1, 2. Preferably, this plate extends over the entire height of the side walls 17, 27 of the container bodies.

Once the applicators or application means, and their outlet orifices, are positioned through the collar, the snap-fastening legs arrive opposite the orifices 330' of the plate 33'. The user then exerts a pressure on the curved walls 18, 28 in order to force the legs 170 to be snap-fastened in the orifices 330'.

In these two embodiments, the coupling means are reversible so that the first and second containers can easily be separated from one another. It is to be understood that other embodiments can also reversibly hold the containers. Once empty, a container can easily be replaced by another container full of the same product or a different product. Similarly, when the user wishes to change the product to be applied or the color, they can easily change one container for another.

According to an alternate embodiment or variant, the protuberances 170 could be provided on the plate 33' and the orifices 330' in the side walls 17, 27 of the container bodies.

It should be noted that a device according to one aspect of the invention can have the advantage of including containers that have their own dispensing and application means. A user can easily change a container when the latter no longer contains any product and replace it with a new one. Furthermore, when one container must be replaced by another container that contains a product of a different type or color, any problem of soiling of the newly dispensed product by a residue of product derived from an old container is avoided.

Furthermore, the user can themselves define and adjust the proportions of each product for the mixture that they desire to create.

Throughout the description, expressions such as "comprising a," "having," "has" or "includes" should be considered as being synonymous with "comprising at least one" unless specified to the contrary. Similarly, expressions with higher numbers (such as "including two") should be understood as synonymous with including at least that number ("including at least two") unless otherwise specified.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A packaging and application device extending along an axis comprising:

a first container which can contain a first product, said first container comprising a first dispensing orifice and a deformable wall, so as to enable the first product to be dispensed through the first dispensing orifice;

a second container which can contain a second product, said second container comprising a second dispensing orifice and a deformable wall, so as to enable the second product to be dispensed through the second dispensing orifice;

a coupling arrangement which is mounted on said first and second containers and which joins said first and second containers together, wherein said first and second dispensing orifices emerge separately at a first application surface and a second application surface respectively, and wherein said first and second containers are configured so as to be able to be actuated independently of one another, wherein said coupling arrangement includes a flexible portion that includes at least two branches that extend along and continuously contact opposing respective side walls of each of the first and second containers such that the coupling arrangement extends along a height at least as great as an entire height of said first and second containers.

2. A device according to claim 1, wherein said device includes a transverse cross section having an elongated shape, and wherein said transverse cross-section includes a length and a width, and wherein the first and second containers are coupled together along the width, with a width of said first container facing toward a width of said second container.

3. A device according to claim 2, wherein the first and second containers are coupled together about a coupling mid-plane essentially parallel or oblique to said width.

4. A device according to claim 2, wherein the first and second containers are arranged so that they each comprise at least one actuating wall extending along said length.

5. A device according to claim 4, wherein each of said containers includes two actuating walls.

6. A device according to claim 1, wherein said first and second containers are arranged to face toward each other along respective sides having a smaller dimension than at least one other side of each of said containers.

7. A device according to claim 6, wherein said first and second containers are in contact with each other.

8. A device according to claim 1, wherein a force exerted on the at least one deformable wall of a container extends along a direction that is not secant to the adjacent container.

9. A device according to claim 1, wherein said first and second containers are coupled together so as to be arranged side by side.

10. A device according to claim 9, wherein said first and second application surfaces are in contact with one another.

11. A device according to claim 9, wherein said first and second application surfaces are flush with one another.

12. A device according to claim 1, wherein said first and second dispensing orifices extend along an axis oblique or perpendicular to a coupling plane of said first and second containers.

13. A device according to claim 1, wherein said device includes a transverse cross section having an elliptical shape.

14. A device according to claim 1, wherein said coupling arrangement comprises a band surrounding at least one part of said first and second containers while leaving said deformable walls accessible.

15. A device according to claim 1, wherein said coupling arrangement reversibly joins said first and second containers so that said first and second containers can be separated from one another.

16. A device according to claim 1, wherein said first and second containers each comprise a container body surmounted by a respective dispensing nozzle that defines said first and second application surfaces.

17. A device according to claim 1, wherein said coupling arrangement comprises application means adjacent said first and second dispensing orifices.

18. A device according to claim 1, wherein said coupling arrangement comprises a collar located at a top portion of the first and second containers, and wherein said coupling arrangement further includes a flexible portion extending from said collar so as to at least partially surround said first and second containers.

19. A device according to claim 1, wherein said flexible portion leaves at least one actuating wall free for each container.

20. A device according to claim 19, wherein said flexible portion leaves two actuating walls free for each container.

21. A device according to claim 1, wherein said flexible portion is joined to a strut which is positioned in contact with respective bases of the containers.

22. A device according to claim 1, wherein said coupling arrangement is attached by snap-fastening to said first and second containers.

23. A device according to claim 1, wherein said device includes a transverse cross section having an elongated shape, and wherein said transverse cross-section includes a length and a width, and wherein said flexible portion extends at least partly in the length of said transverse cross section of the device.

24. A device according to claim 1, wherein said flexible portion extends along a respective curved wall of each of said first and second containers.

25. A device according to claim 1, wherein said coupling arrangement comprises an attachment location for a cap.

26. A device according to claim 1, wherein said coupling arrangement extends at least partially between said first and second containers.

27. A device according to claim 26, wherein said coupling arrangement includes a plate positioned between said first and second containers, and wherein said first and second containers are attached to said plate by snap-fastening.

28. A packaging and application device extending along an axis comprising:

a first container which can contain a first product, said first container comprising a first dispensing orifice and a deformable wall, so as to enable the first product to be dispensed through the first dispensing orifice;

a second container which can contain a second product, said second container comprising a second dispensing orifice and a deformable wall, so as to enable the second product to be dispensed through the second dispensing orifice;

a coupling arrangement that is capable of joining said first and second containers together, wherein said device includes a transverse cross section having an elongated shape, and wherein said transverse cross-section includes a length and a width, and wherein the first and second containers are coupled together widthwise such that width of said first container faces toward a width of said second container in order to be able to be actuated independently of one another, wherein said coupling arrangement includes a part that extends around and grips side surfaces of each of the first and second containers, and wherein said part is joined to a strut, the strut located along each of respective bottom surfaces of the containers and contacting each of the respective bottom surfaces of the containers.

29. A packaging and application device comprising:

a first container which can contain a first product, said first container comprising a first dispensing orifice and a deformable wall, so as to enable the first product to be dispensed through the first dispensing orifice;

a second container which can contain a second product, said second container comprising a second dispensing orifice and a deformable wall, so as to enable the second product to be dispensed through the second dispensing orifice;

a coupling arrangement that joins said first and second containers together from a top surface of each of the containers to a bottom surface of each of the containers, wherein said first and second containers are configured so as to be able to be actuated independently of one another so that a direction of force exerted on at least one deformable wall of one of said first and second containers does not extend along a direction that intersects with the other container, wherein the first and second dispensing orifices are located along the respective top surfaces of the first and second containers, and wherein said device includes a transverse cross section having an elongated shape with a length and a width, and wherein the first and second containers are coupled together along the width from the top surface to the bottom surface, with a width of the first container facing toward a width of said second container.

30. A device for coupling, comprising:

a first container configured to contain a first product, said first container including a first dispensing orifice extending from a top surface of the first container, and a deformable wall, so as to enable the first product to be dispensed through the first dispensing orifice;

a second container configured to contain a second product, said second container including a second dispensing orifice extending from a top surface of the second container, and a deformable wall, so as to enable the second product to be dispensed through the second dispensing orifice; and a coupling arrangement including a collar that extends above each of said first and second containers, and a gripping part which extends from said collar, wherein said collar and said gripping part extend completely around said first and second containers, and said gripping part continuously contacts and grips outer surfaces of the first and second containers, and wherein said collar extends across and covers an entirety of the top surface of each of the first and second containers.

31. A method of applying a cosmetic product comprising the steps of:

providing a device according to claim 29;

actuating the first and second containers independently in order to dispense the first product and the second product in different proportions onto an area of a body; and spreading and mixing said first and second products on said area of the body using application means.

32. A method according to claim 31, wherein said packaging and application device includes said application means.

33. A method according to claim 32, wherein said area of the body includes a users lips.

* * * * *